US007111681B2

(12) United States Patent
Detournay et al.

(10) Patent No.: US 7,111,681 B2
(45) Date of Patent: Sep. 26, 2006

(54) INTERPRETATION AND DESIGN OF HYDRAULIC FRACTURING TREATMENTS

(75) Inventors: Emmanuel Detournay, Roseville, MN (US); Jose Ignacio Adachi, Stafford, TX (US); Dmitriy Igor Garagash, Potsdam, NY (US); Alexei A. Savitski, Houston, TX (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 10/356,373

(22) Filed: Jan. 31, 2003

(65) Prior Publication Data

US 2004/0016541 A1 Jan. 29, 2004

Related U.S. Application Data

(60) Provisional application No. 60/353,413, filed on Feb. 1, 2002.

(51) Int. Cl.
*E21B 47/00* (2006.01)
*E21B 43/26* (2006.01)

(52) U.S. Cl. ..... 166/250.1; 166/308.1; 73/152.41; 702/6; 703/10

(58) Field of Classification Search ..... 166/250.01, 166/250.1, 283, 305.1, 308.1, 177.5; 73/152.39, 73/152.41; 702/6–13, 113, 114; 703/2, 6, 703/9, 10

See application file for complete search history.

(56) References Cited

U.S. PATENT DOCUMENTS 4,398,416 A * 8/1983 Nolte ..... 73/152.39
4,442,897 A * 4/1984 Crowell ..... 166/280.2
4,749,038 A * 6/1988 Shelley ..... 166/250.1
4,797,821 A 1/1989 Petak et al. ..... 364/422
4,828,028 A * 5/1989 Soliman ..... 166/250.1
4,832,121 A * 5/1989 Anderson ..... 166/250.09
4,836,280 A * 6/1989 Soliman ..... 166/250.1
4,848,461 A * 7/1989 Lee ..... 166/250.1
5,005,643 A * 4/1991 Soliman et al. ..... 166/250.1
5,070,457 A * 12/1991 Poulsen ..... 702/12
5,111,881 A * 5/1992 Soliman et al. ..... 166/250.1
5,183,109 A * 2/1993 Poulsen ..... 166/250.1
5,205,164 A * 4/1993 Steiger et al. ..... 73/152.11
5,275,041 A * 1/1994 Poulsen ..... 73/152.31
5,305,211 A * 4/1994 Soliman ..... 702/12
5,322,126 A * 6/1994 Scott, III ..... 166/308.1
5,360,066 A * 11/1994 Venditto et al. ..... 166/250.1
5,377,104 A * 12/1994 Sorrells et al. ..... 702/11
5,413,179 A * 5/1995 Scott, III ..... 166/308.1
5,441,110 A * 8/1995 Scott, III ..... 166/308.1
5,497,831 A * 3/1996 Hainey et al. ..... 166/308.1
5,934,373 A * 8/1999 Warpinski et al. ..... 166/250.1
5,963,508 A * 10/1999 Withers ..... 367/38
6,069,118 A * 5/2000 Hinkel et al. ..... 507/277
6,076,046 A * 6/2000 Vasudevan et al. ..... 702/12
6,101,447 A 8/2000 Poe, Jr. ..... 702/13

(Continued)

FOREIGN PATENT DOCUMENTS

EP 0456339 11/1991

(Continued)

*Primary Examiner*—Jennifer H. Gay
(74) *Attorney, Agent, or Firm*—Schwegman, Lundberg, Woessner & Kluth, P.A.

(57) ABSTRACT

Solutions for the propagation of a hydraulic fracture in a permeable elastic rock and driven by injection of a Newtonian fluid. Through scaling, the dependence of the solution on the problem parameters is reduced to a small number of dimensionless parameters.

7 Claims, 6 Drawing Sheets

U.S. PATENT DOCUMENTS

| | | | | |
|---|---|---|---|---|
| 6,431,278 | B1 * | 8/2002 | Guinot et al. | 166/252.5 |
| 6,439,310 | B1 * | 8/2002 | Scott et al. | 166/308.1 |
| 2002/0010570 | A1 * | 1/2002 | Malthe-Sorenssen et al. | 703/10 |
| 2002/0029137 | A1 * | 3/2002 | Malthe-Sorenssen et al. | 703/10 |
| 2002/0091502 | A1 * | 7/2002 | Malthe-Sorenssen et al. | 703/2 |
| 2002/0120429 | A1 * | 8/2002 | Ortoleva | 703/2 |
| 2003/0050758 | A1 * | 3/2003 | Soliman et al. | 702/6 |
| 2003/0078732 | A1 * | 4/2003 | Pandey et al. | 702/6 |
| 2003/0079875 | A1 * | 5/2003 | Weng | 166/250.07 |
| 2003/0205376 | A1 * | 11/2003 | Ayoub et al. | 166/254.2 |
| 2003/0225522 | A1 * | 12/2003 | Poe | 702/11 |
| 2004/0117121 | A1 * | 6/2004 | Gray et al. | 702/11 |
| 2004/0226715 | A1 * | 11/2004 | Willberg et al. | 166/250.1 |

FOREIGN PATENT DOCUMENTS

| | | | |
|---|---|---|---|
| EP | 0589591 | | 3/1994 |
| EP | 1296019 | A1 * | 3/2003 |

* cited by examiner

INTERPRETATION AND DESIGN OF HYDRAULIC FRACTURING TREATMENTS

RELATED APPLICATION

This application claims the benefit of priority under 35 U.S.C. 119(e) to U.S. Provisional Patent Application Ser. No. 60/353,413, filed Feb. 1, 2002, which is incorporated herein by reference.

FIELD

The present invention relates generally to fluid flow, and more specifically to fluid flow in hydraulic fracturing operations.

BACKGROUND

A particular class of fractures in the Earth develops as a result of internal pressurization by a viscous fluid. These fractures are either man-made hydraulic fractures created by injecting a viscous fluid from a borehole, or natural fractures such as kilometers-long volcanic dikes driven by magma coming from the upper mantle beneath the Earth's crust. Man-made hydraulic fracturing "treatments" have been performed for many decades, and for many purposes, including the recovery of oil and gas from underground hydrocarbon reservoirs.

Despite the decades-long practice of hydraulic fracturing, many questions remain with respect to the dynamics of the process. Questions such as: how is the fracture evolving in shape and size; how is the fracturing pressure varying with time; what is the process dependence on the properties of the rock, on the in situ stresses, on the properties of both the fracturing fluid and the pore fluid, and on the boundary conditions? Some of the difficulties of answering these questions originate from the non-linear nature of the equation governing the flow of fluid in the fracture, the non-local character of the elastic response of the fracture, and the time-dependence of the equation governing the exchange of fluid between the fracture and the rock. Non-locality, non-linearity, and history-dependence conspire to yield a complex solution structure that involves coupled processes at multiple small scales near the tip of the fracture.

Early modeling efforts focused on analytical solutions for fluid-driven fractures of simple geometry, either straight in-plane strain or penny-shaped. They were mainly motivated by the problem of designing hydraulic fracturing treatments. These solutions were typically constructed, however, with strong ad hoc assumptions not clearly supported by relevant physical arguments. In recent years, the limitations of these solutions have shifted the focus of research in the petroleum industry towards the development of numerical algorithms to model the three-dimensional propagation of hydraulic fractures in layered strata characterized by different mechanical properties and/or in-situ stresses. Devising a method that can robustly and accurately solve the set of coupled non-linear history-dependent integro-differential equations governing this problem will advance the ability to predict and interactively control the dynamic behavior of hydraulic fracture propagation.

For the reasons stated above, and for other reasons stated below which will become apparent to those skilled in the art upon reading and understanding the present specification, there is a need in the art for alternate methods for modeling various behaviors of hydraulic fracturing operations.

DESCRIPTION OF EMBODIMENTS

Figure 1:
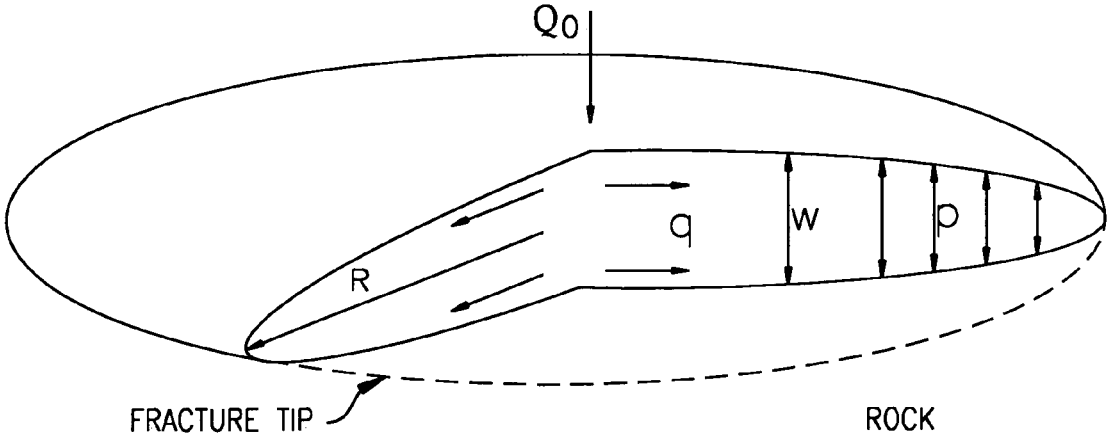
FIG. 1 shows a view of a radial fluid-driven fracture with an exaggerated aperture.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

The processes associated with hydraulic fracturing include injecting a viscous fluid into a well under high pressure to initiate and propagate a fracture. The design of a treatment relies on the ability to predict the opening and the size of the fracture as well as the pressure of the fracturing fluid, as a function of the properties of the rock and the fluid. However, in view of the great uncertainty in the in-situ conditions, it is helpful to identify key dimensionless parameters and to understand the dependence of the hydraulic fracturing process on these parameters. In that respect, the availability of solutions for idealized situations can be very valuable. For example, idealized situations such as penny-shaped (or "radial") fluid-driven fractures and plane strain (often referred to as "KGD," an acronym from the names of researchers) fluid-driven fractures offer promise. Furthermore, the two types of simple geometries (radial and planar) are fundamentally related to the two basic types of boundary conditions corresponding to the fluid "point"-source and the fluid "line"-source, respectively.

Various embodiments of the present invention create opportunities for significant improvement in the design of hydraulic fracturing treatments in petroleum industry. For example, numerical algorithms used for simulation of actual hydraulic fracturing treatments in varying stress environment in inhomogeneous rock mass, can be significantly improved by embedding the correct evolving structure of the tip solution as described herein. Also for example, various solutions of a radial fracture in homogeneous rock and constant in-situ stress present non-trivial benchmark problems for the numerical codes for realistic hydraulic fractures in layered rocks and changing stress environment. Also, mapping of the solution in a reduced dimensionless parametric space opens an opportunity for a rigorous solution of an inverse problem of identification of the parameters which characterize the reservoir rock and the in-situ state of stress from the data collected during hydraulic fracturing treatment.

Various applications of man-made hydraulic fractures include sequestration of $CO_2$ in deep geological layers, stimulation of geothermal reservoirs and hydrocarbon reservoirs, cuttings reinjection, preconditioning of a rock mass in mining operations, progressive closure of a mine roof, and determination of in-situ stresses at great depth. Injection of fluid under pressure into fracture systems at depth can also be used to trigger earthquakes, and holds promise as a technique to control energy release along active fault systems.

Mathematical models of hydraulic fractures propagating in permeable rocks should account for the primary physical mechanisms involved, namely, deformation of the rock, fracturing or creation of new surfaces in the rock, flow of viscous fluid in the fracture, and leak-off of the fracturing fluid into the permeable rock. The parameters quantifying these processes correspond to the Young's modulus E and Poisson's ratio $\nu$, the rock toughness $K_{Ic}$, the fracturing fluid viscosity $\mu$ (assuming a Newtonian fluid), and the leak-off coefficient $C_l$, respectively. There is also the issue of the fluid lag $\lambda$, the distance between the front of the fracturing fluid and the crack edge, which brings into the formulation the magnitude of far-field stress $\sigma_o$ (perpendicular to the fracture plane) and the virgin pore pressure $p_o$.

Multiple embodiments of the present invention are described in this disclosure. Some embodiments deal with radial hydraulic fractures, and some other embodiments deal with plane strain (KGD) fractures, and still other embodiments are general to all types of fractures. Further, different embodiments employ various scalings and various parametric spaces. For purposes of illustration, and not by way of limitation, the remainder of this disclosure is organized by different types of parametric spaces, and various other organizational breakdowns are provided within the discussion of the different types of parametric spaces.

I. Embodiments Utilizing a First Parametric Space

A. Radial Fractures

Figure 2:
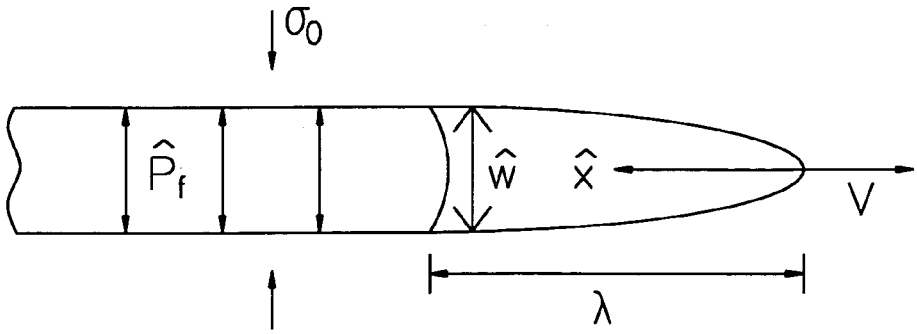
FIG. 2 shows a tip of a fluid-driven fracture with lag.

The problem of a radial hydraulic fracture driven by injecting a viscous fluid from a "point"-source, at a constant volumetric rate $Q_o$ is schematically shown in FIGS. 1 and 2. Under conditions where the lag is negligible ($\lambda/R \ll 1$), determining the solution of this problem consists of finding the aperture w of the fracture, and the net pressure p (the difference between the fluid pressure $p_f$ and the far-field stress $\sigma_o$) as a function of both the radial coordinate r and time t, as well as the evolution of the fracture radius R(t). The functions R(t), w(r,t), and p(r,t) depend on the injection rate $Q_o$ and on the 4 material parameters E', $\mu$', K', and C' respectively defined as $$E' = \frac{E}{1-\nu^2} \quad \mu' = 12\mu \quad K' = 4\left(\frac{2}{\pi}\right)^{1/2} K_{Ic} \quad C' = 2C_l \tag{1}$$

The three functions R(t), w(r,t), and p(r,t) are determined by solving a set of equations which can be summarized as follows.

Elasticity Equation:

$$w = \frac{R}{E'}\int_0^1 G(r/R, s)p(sR, t)s\,ds \tag{2}$$

where G is a known elastic kernel. This singular integral equation expresses the non-local dependence of the fracture width w on the net pressure p.

Lubrication Equation:

$$\frac{\partial w}{\partial t} + g = \frac{1}{\mu'}\frac{1}{r}\frac{\partial}{\partial r}\left(rw^3\frac{\partial p}{\partial r}\right) \tag{3}$$

This non-linear differential equation governs the flow of viscous incompressible fluid inside the fracture. The function g(r,t) denotes the rate of fluid leak-off, which evolves according to $$g = \frac{C'}{\sqrt{t - t_o(r)}} \tag{4}$$

where $t_o$ (r) is the exposure time of point r (i.e., the time at which the fracture front was at a distance r from the injection point). The leak-off law (4) is an approximation with the constant C' lumping various small scale processes (such as displacement of the pore fluid by the fracturing fluid). In general, (4) can be defended under conditions where the leak-off diffusion length is small compared to the fracture length.

Global Volume Balance:

$$Q_o t = 2\pi\int_0^R wr\,dr + 2\pi\int_0^r r\int_0^{R(\tau)} g(r,\tau)\,dr\,d\tau \tag{5}$$

This equation expresses that the total volume of fluid injected is equal to the sum of the fracture volume and the volume of fluid lost in the rock surrounding the fracture.

Propagation Criterion:

$$w \simeq \frac{K'}{E'}\sqrt{R-r}, \quad 1 - \frac{r}{R} \ll 1 \tag{6}$$

Within the framework of linear elastic fracture mechanics, this equation embodies the fact that the fracture is always propagating and that energy is dissipated continuously in the creation of new surfaces in rock (at a constant rate per unit surface). Note that (6) implies that w=0 at the tip.

Tip Conditions:

$$w^3 \frac{\partial p}{\partial r} = 0, \quad r = R \tag{7}$$

This zero fluid flow rate condition (q=0) at the fracture tip is applicable only if the fluid is completely filling the fracture (including the tip region) or if the lag is negligible at the scale of the fracture. Otherwise, the equations have to be altered to account for the phenomena taking place in the lag zone as discussed below. Furthermore, the lag size $\lambda(t)$ is unknown, see FIG. 2.

The formulated model for the radial fracture or similar model for a planar fracture gives a rigorous account for various physical mechanisms governing the propagation of hydraulic fractures, however, is based on number of assumptions which may not hold for some specific classes of fractures. Particularly, the effect of fracturing fluid buoyancy (the difference between the density of fracturing fluid and the density of the host rock) is one of the driving mechanisms of vertical magma dykes (though, inconsequential for the horizontal disk shaped magma fractures) is not considered in this proposal. Other processes which could be relevant for the hydraulic fracture propagation under certain limited conditions which are not discussed here include a process zone near the fracture tip, fracturing fluid cooling and solidification effects (as relevant to magma-driven fractures), capillarity effects at the fluid front in the fracture, and deviations from the one-dimensional leak-off law.

1. Propagation Regimes of Finite Fractures

Scaling laws for finite radial fracture driven by fluid injected at a constant rate are considered next. Similar scaling can be developed for other geometries and boundary conditions. Regimes with negligible fluid lag are differentiated from regimes with non-negligible fluid lag.

a. Regimes with Negligible Fluid Lag.

Propagation of a hydraulic fracture with zero lag is governed by two competing dissipative processes associated with fluid viscosity and solid toughness, respectively, and two competing components of the fluid balance associated with fluid storage in the fracture and fluid storage in the surrounding rock (leak-off). Consequently, limiting regimes of propagation of a fracture can be associated with dominance of one of the two dissipative processes and/or dominance of one of the two fluid storage mechanisms. Thus, four primary asymptotic regimes of hydraulic fracture propagation with zero lag can be identified where one of the two dissipative mechanisms and one of the two fluid storage components are vanishing: storage-viscosity (M), storage-toughness (K), leak-off-viscosity ($\tilde{M}$), and leak-off-toughness ($\tilde{K}$) dominated regimes. For example, fluid leak-off is negligible compared to the fluid storage in the fracture and the energy dissipated in the flow of viscous fluid in the fracture is negligible compared to the energy expended in fracturing the rock in the storage-viscosity-dominated regime (M). The solution in the storage-viscosity-dominated regime is given by the zero-toughness, zero-leak-off solution (K'=C'=0). As used herein, the letters M (for viscosity) and K (for toughness) are used to identify which dissipative process is dominant and the symbol tilde (~) (for leak-off) and no-tilde (for storage in the fracture) are used to identify which fluid balance mechanism is dominant.

Consider general scaling of the finite fracture which hinges on defining the dimensionless crack opening $\Omega$, net pressure $\Pi$, and fracture radius $\gamma$ as:

$$w=\epsilon\Omega(\rho;P_1,P_2),\ p=\epsilon E'\Pi(\rho;P_1,P_2),\ R=\gamma(P_1,P_2)L \tag{8}$$

These definitions introduce a scaled coordinate $\rho=r/R(t)$ ($0\leqq\rho\leqq1$), a small number $\epsilon(t)$, a length scale L(t) of the same order of magnitude as the fracture length R(t), and two dimensionless evolution parameters $P_1(t)$ and P2(t), which depend monotonically on t. The form of the scaling (8) can be motivated from elementary elasticity considerations, by noting that the average aperture scaled by the fracture radius is of the same order as the average net pressure scaled by the elastic modulus.

Four different scalings can be defined to emphasize above different primary limiting cases. These scalings yield power law dependence of L, $\epsilon$, $P_1$, and $P_2$ on time t; i.e. $L\sim t^{\alpha}$, $\epsilon\sim t^{\delta}$, $P_1\sim t^{\beta_1}$, $P_2\sim t^{\beta_2}$, see Table 1 for the case of a radial fracture. Furthermore, the evolution parameters can take either the meaning of a toughness ($K_m$, $K_{\tilde{m}}$), or a viscosity ($M_k$, $M_{\tilde{k}}$), or a storage ($S_{\tilde{m}}$, $S_{\tilde{k}}$) or a leak-off coefficient ($C_m$, $C_k$).

| Scaling | $\epsilon$ | L | $P_1$ | $P_2$ |
|---|---|---|---|---|
| storage/ viscosity(M) | $\left(\frac{\mu'}{E't}\right)^{1/3}$ | $\left(\frac{E'Q_o^3t^4}{\mu'}\right)^{1/9}$ | $K_m = K'\left(\frac{t^2}{\mu'^5E'^{13}Q_o^3}\right)^{1/18}$ | $C_m = C'\left(\frac{E'^3t^7}{\mu'^4Q_o^6}\right)^{1/18}$ |
| storage/ toughness(K) | $\left(\frac{K'^6}{E'^6Q_ot}\right)^{1/5}$ | $\left(\frac{E'Q_ot}{K'}\right)^{2/5}$ | $M_k = \mu'\left(\frac{Q_o^3E'^{13}}{K'^{18}t^2}\right)^{1/5}$ | $C_k = C'\left(\frac{E'^8t^3}{K'^8Q_o^2}\right)^{1/10}$ |
| leak-off/ viscosity(M) | $\left(\frac{\mu'^4C'^6}{E'^4Q_o^2t^3}\right)^{\frac{1}{16}}$ | $\left(\frac{Q_o^2t}{C'^2}\right)^{1/4}$ | $K_{\tilde{m}} = K'\left(\frac{t}{E'^{12}\mu'^4C'^2Q_o^2}\right)^{\frac{1}{16}}$ | $S_{\tilde{m}} = \left(\frac{\mu'^4Q_o^6}{E'^4C'^{18}t^7}\right)^{1/16}$ |
| leak-off/ toughness(K) | $\left(\frac{K'^8C'^2}{E'^8Q_o^2t}\right)^{1/8}$ | $\left(\frac{Q_o^2t}{C'^2}\right)^{1/4}$ | $M_{\tilde{k}} = \mu'\left(\frac{E'^{12}C'^2Q_o^2}{K'^{16}t}\right)^{1/4}$ | $S_{\tilde{k}} = \left(\frac{K'^8Q_o^2}{E'^8C'^{10}t^3}\right)^{1/8}$ |

Table 1. Small parameter $\epsilon$, lengthscale L, and parameters $P_1$ and $P_2$ for the two storage scalings (viscosity and toughness) and the two leak-off scalings (viscosity and toughness).

Figure 3:
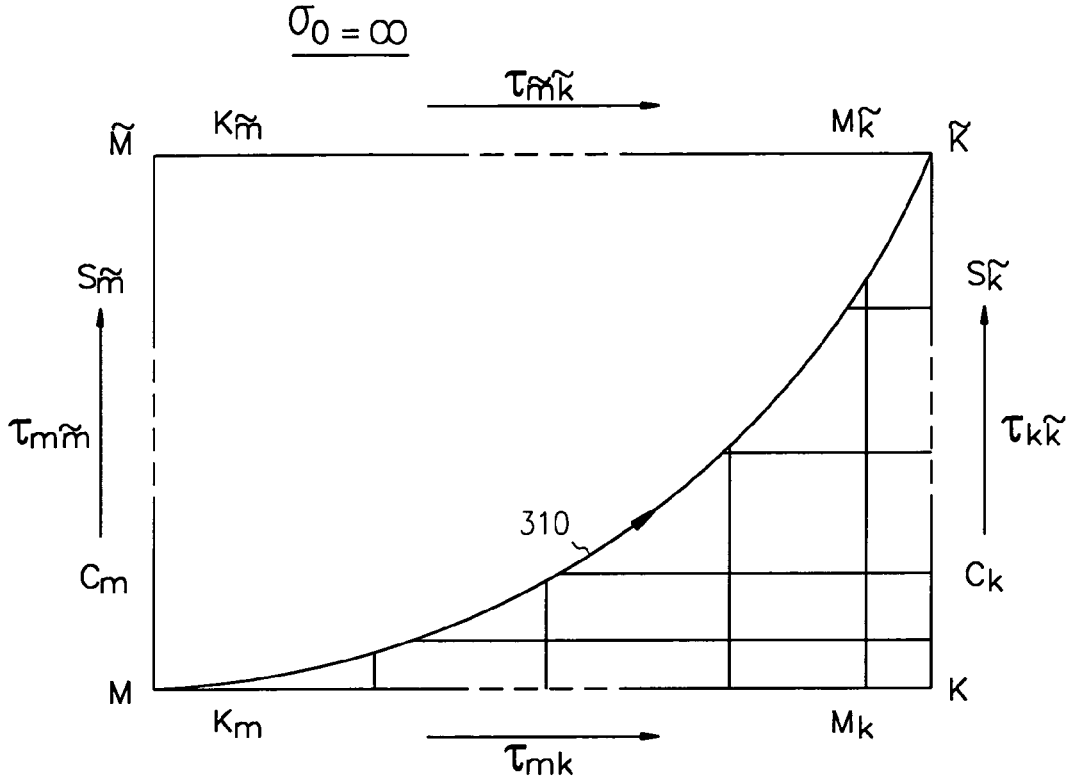
FIG. 3 shows a rectangular parametric space.

The regimes of solutions can be conceptualized in a rectangular parametric space MK$\tilde{K}\tilde{M}$ shown in FIG. 3. Each of the four primary regimes (M, K, $\tilde{M}$, and $\tilde{K}$) of hydraulic fracture propagation corresponding to the vertices of the diagram is dominated by only one component of fluid global balance while the other can be neglected (i.e. respective $P_1$=0, see Table 1) and only one dissipative process while the other can be neglected (i.e. respective $P_2$=0, see Table 1). The solution for each of the primary regimes has the property that it evolves with time t according to a power law. In particular, the fracture radius R evolves in these regimes according to $l \sim t^{\alpha}$ where the exponent $\alpha$ depends on the regime of propagation: $\alpha$=4/9,2/5,1/4,1/4 in the M-, K-, $\tilde{M}$-, $\tilde{K}$-regime, respectively. As follows from the stationary tip solution (see below), the behavior of the solution at the tip also depends on the regime of solution: $\Omega \sim (1-\rho)^{2/3}$ at the M-vertex, $\Omega \sim (1-\rho)^{5/8}$ at the $\tilde{M}$-vertex, and $\Omega \sim (1-\rho)^{1/2}$ at the K- and $\tilde{K}$-vertices.

The edges of the rectangular phase diagram MK$\tilde{K}\tilde{M}$ can be identified with the four secondary limiting regimes corresponding to either the dominance of one of the two fluid global balance mechanisms or the dominance of one of the two energy dissipation mechanisms: storage-edge (MK, $C_m=C_k=0$), leak-off-edge ($\tilde{M}\tilde{K}$, $S_{\tilde{m}}=S_{\tilde{k}}=0$), viscosity-edge (M $\tilde{M}$, $K_m=K_{\tilde{m}}=0$), and K$\tilde{K}$-toughness-edge ($M_k=M_{\tilde{k}}=0$).

The regime of propagation evolves with time, since the parameters M's, K's, C's and S's depend on t. With respect to the evolution of the solution in time, it is useful to locate the position of the state point in the MK$\tilde{K}\tilde{M}$ space in terms of the dimensionless times $\tau_{mk}=t/t_{mk}$, $\tau_{\tilde{m}\tilde{k}}=t/t_{\tilde{m}\tilde{k}}$, $\tau_{\tilde{m}\tilde{m}}=t/t_{\tilde{m}\tilde{m}}$, and $\tau_{k\tilde{k}}=t/t_{k\tilde{k}}$ where the time scales are defined as $$t_{mk} = \left(\frac{\mu'^5 E'^{13} Q_o^3}{K'^{18}}\right)^{1/2}, \tag{9a}$$

$$t_{\tilde{m}\tilde{k}} = \frac{\mu'^4 E'^2 C'^2 Q_o^2}{K'^6} \tag{9b}$$

$$t_{m\tilde{m}} = \left(\frac{\mu'^4 Q_o^6}{E'^4 C'^{18}}\right)^{1/7} \tag{9c}$$

$$t_{k\tilde{k}} = \left(\frac{\mu'^8 Q_o^2}{E'^8 C'^{10}}\right)^{1/3} \tag{9d}$$

Only two of these times are independent, however, since $t_{\tilde{m}\tilde{k}}=t_{mk}^{8/5}t_{k\tilde{k}}^{-3/5}$ *and* $t_{m\tilde{m}}=t_{mk}^{8/35}t_{k\tilde{k}}^{27/35}$. Note that the parameters M's, K's, C's and S's can be simply expressed in terms of these times according to The dimensionless times $\tau$'s define evolution of the solution along the respective edges of the rectangular space MK$\tilde{K}\tilde{M}$. A point in the parametric space MK$\tilde{K}\tilde{M}$ is thus completely defined by any pair combination of these four times, say ($\tau_{mk}$, $\tau_{k\tilde{k}}$). The position ($\tau_{mk}$, $\tau_{k\tilde{k}}$) of the state point can in fact be conceptualized at the intersection of two rays, perpendicular to the storage- and toughness-edges respectively. Furthermore, the evolution of the solution regime in the MK$\tilde{K}\tilde{M}$ space takes place along a trajectory corresponding to a constant value of the parameter $\eta$, which is related to the ratios of characteristic times $$\eta = \frac{E'^{11/2}\mu'^{3/2}C'^2 Q_o^{1/2}}{K'^7}, \text{ with } \frac{t_{m\tilde{m}}}{t_{mk}} = \eta,\ \frac{t_{m\tilde{m}}}{t_{mk}} = \eta,\ \frac{t_{k\tilde{k}}}{t_{mk}} = \eta^{-5/3},\ \frac{t_{m\tilde{m}}}{t_{k\tilde{k}}} = \eta^{8/21} \tag{11}$$

(One of such trajectories is shown at 310 in FIG. 3).

In view of the dependence of the parameters M's, K's, C's, and S's on time, (10), the M-vertex corresponds to the origin of time, and the $\tilde{K}$-vertex to the end of time (except for an impermeable rock). Thus, given all the problem parameters which completely define the number $\eta$, the system evolves with time (say time $\tau_{mk}$) along a $\eta$-trajectory, starting from the M-vertex ($K_m$=0, $C_m$=0) and ending at the $\tilde{K}$-vertex ($M_{\tilde{k}}$=0, $S_{\tilde{k}}$=0). If $\eta$=0, two possibilities exist: either the rock is impermeable (C'=0) and the system evolves along the storage edge from M to K, or the fluid is inviscid ($\mu'$=0) and the system then evolves along the toughness-edge from K to $\tilde{K}$. If $\eta=\infty$, then either K'=0 (corresponding to a pre-existing discontinuity), and the system evolves along the viscosity-edge from M to $\tilde{M}$; or C'=$\infty$ (corresponding to zero fluid storage in the fracture) and the system evolves along the leak-off-edge from the $\tilde{M}$ to the $\tilde{K}$. Thus when $\eta$ is decreasing (which can be interpreted for example as an decreasing ratio $t_{m\tilde{m}}/t_{mk}$), the trajectory is attracted by the K-vertex, and when $\eta$ is increasing the trajectory is attracted to the $\tilde{M}$-vertex. The dependence of the scaled solution F can thus be expressed in the form $F(\rho,\tau;\eta)$, where $\tau$ is one of the dimensionless time, irrespective of the adopted scaling.

b. Regimes with Non-negligible Fluid Lag.

Under certain conditions (e.g., when a fracture propagates along pre-existing discontinuity K'=0 and confining stress $\sigma_o$ is small enough), the length of the lag between the crack tip and the fluid front cannot be neglected with respect to the fracture size. In some embodiments of the present invention, fluid pressure in the lag zone can be considered to be zero compared to the far-field stress $\sigma_o$, either because the rock is impermeable or because there is cavitation of the pore fluid. Under these conditions, the presence of the lag brings $\sigma_o$ in the problem description, through an additional evolution parameter $P_3(t)$, which is denoted $T_m$ in the M-scaling (or $T_{\tilde{m}}$ in the $\tilde{M}$-scaling) and has the meaning of dimensionless confining stress. This extra parameter can be expressed in terms of an additional dimensionless time as $$K_m = M_{\tilde{k}}^{-5/18} = \tau_{mk}^{1/9},\ K_{\tilde{m}} = M_{\tilde{k}}^{-1/4} = \tau_{\tilde{m}\tilde{k}}^{1/16},\ C_m = S_{\tilde{m}}^{-8/9} = \tau_{m\tilde{m}}^{7/18},\ C_k = S_{\tilde{k}}^{-4/5} = \tau_{k\tilde{k}}^{3/10} \tag{10}$$

$$T_m = \tau_{om}^{1/3} \text{ with } \tau_{om} = \frac{t}{t_{om}} \text{ and } t_{om} = \frac{\mu' E'^2}{\sigma_o^3} \tag{12}$$

Figure 4:
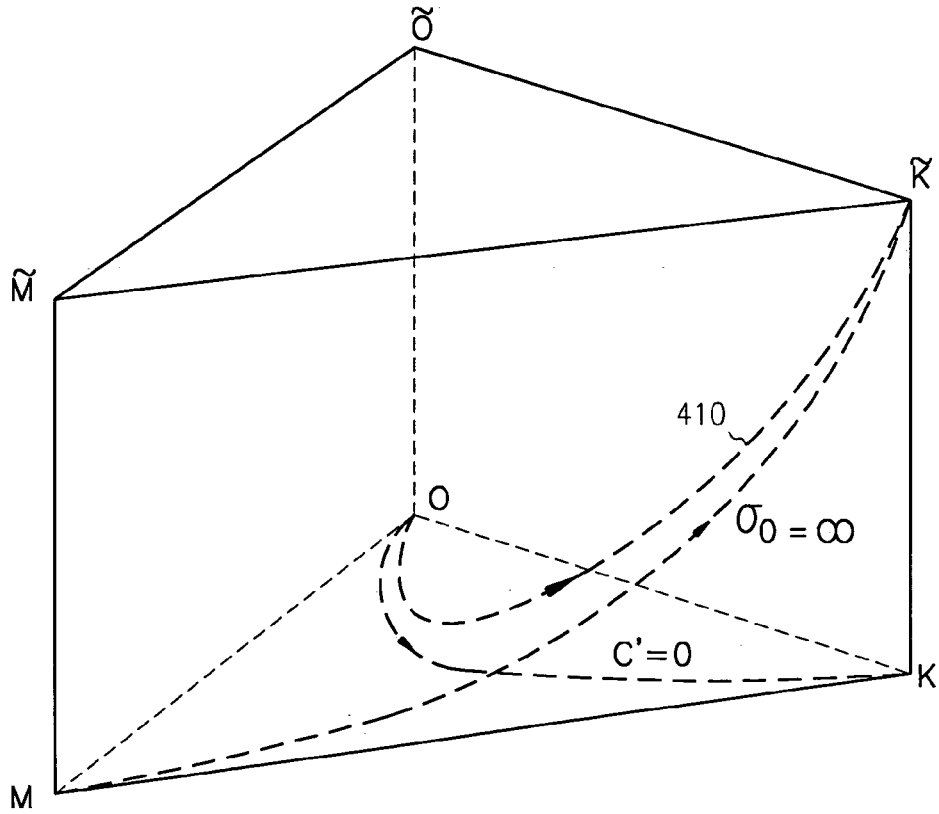
FIG. 4 shows a pyramid-shaped parametric space.

Now the parametric space can be envisioned as the pyramid MKK̃M̃-OÕ, depicted in FIG. 4, with the position of the state point identified by a triplet, e.g., ($T_m$,$K_m$, $C_k$) or ($\tau_{om}$,$\tau_{mk}$,$\tau_{\tilde{k}\tilde{k}}$). In accord with the discussion of the zero lag case, OÕ-edge corresponds to the viscosity-dominated regime ($K_m$=$K_{\tilde{m}}$=0) under condition of vanishing confining stress ($T_m$=$T_{\tilde{m}}$=0), where the endpoints, O- and Õ-vertices correspond to the limits of storage and leak-off-dominated cases.

The system evolves from the O-vertex towards the K̃-vertex following a trajectory which depends on all the physical ground, as otherwise the fluid pressure at the tip has negative singularity, there are circumstances where λ is small enough compared to the relevant lengthscales that it can be neglected. (This issue is similar to the use of the solutions of linear elastic fracture mechanics which yield "unphysical" stress singularity at the fracture tip). In these regimes/scales, the solution is characterized by a singular behavior, with the nature of the singularity being a function of the problem parameters and the scale of reference.

a. Regimes/scales with Negligible Fluid Lag.

Figure 6:
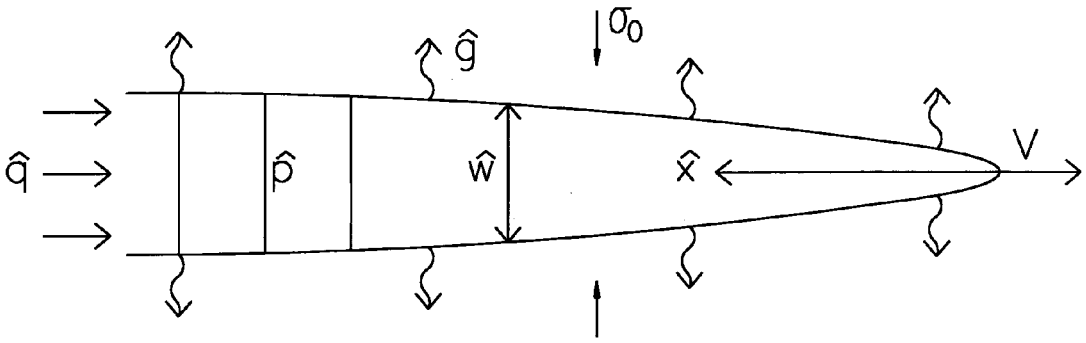
FIG. 6 shows a semi-infinite fluid-driven crack propagating in elastic, permeable rock.
Figure 7:
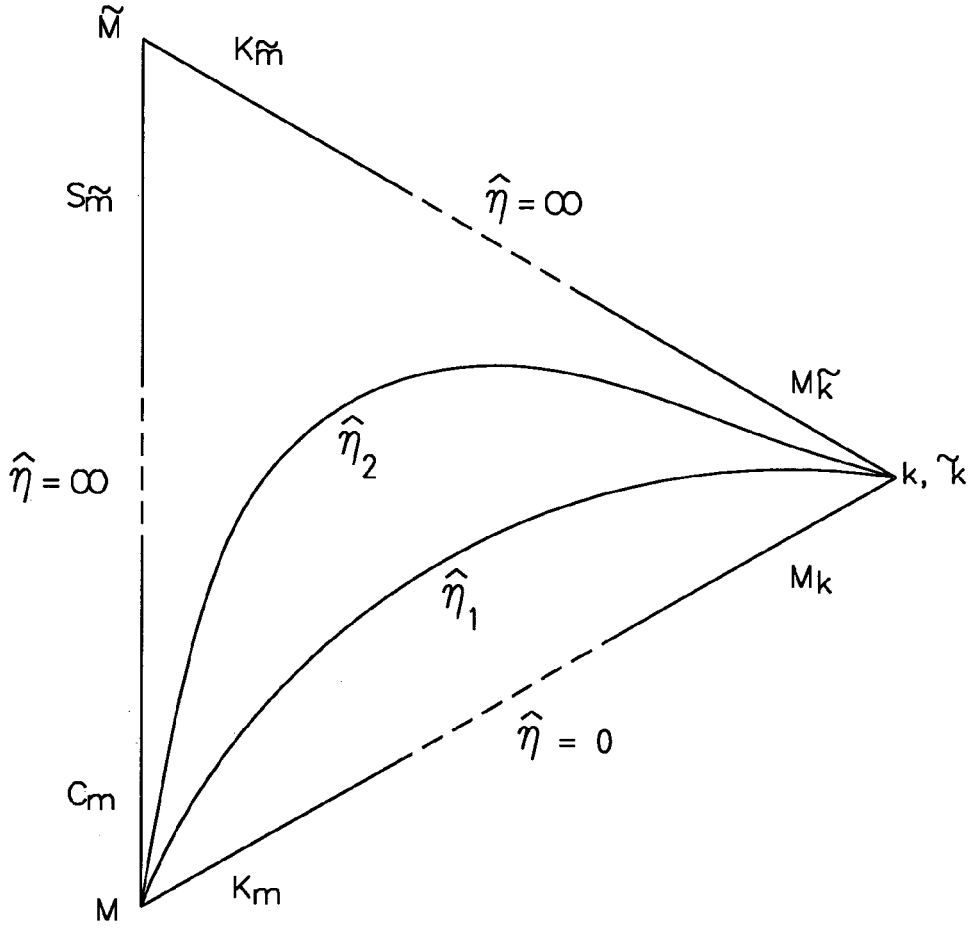
FIG. 7 shows another triangular parametric space.

In view of the stationary nature of the considered tip problem, the fracture opening ŵ, net pressure p̂ and flow rate q̂ are only a function of the moving coordinate x̂, see FIGS. 6 and 7. The system of equations governing ŵ(x̂) and p̂(x̂) can be written as $$\hat{p} = \frac{E'}{4\pi}\int_0^\infty \frac{d\hat{w}}{d\hat{s}}\frac{d\hat{s}}{\hat{x}-\hat{s}},\ \frac{\hat{w}^3}{\mu'}\frac{d\hat{p}}{d\hat{x}} = V\hat{w} + 2C'V^{1/2}\hat{x}^{1/2},\ \lim_{\hat{x}\to 0}\frac{\hat{w}}{\hat{x}^{1/2}} = \frac{K'}{E'},\ \lim_{\hat{x}\to 0}\hat{w}^3\frac{d\hat{p}}{d\hat{x}} = 0 \tag{13}$$

parameters of the problem (410, FIG. 4). The trajectory depends on two numbers which can be taken as η defined in (11) (independent of $\sigma_o$) and $\phi = t_{om}/t_{mk}$. It should be noted that the O-vertex from where fracture evolution initiates is a singular point as (i) it corresponds to the infinitely fast initial fracture propagation (propagation of an unconfined fracture, $\sigma_o$=0, along preexisting discontinuity, K'=0) (ii) it corresponds to the infinite multitude of self-similar solutions parameterized by the ray along which the solution trajectory is emerging from the O-vertex.

If φ<<1 and φ<<η (e.g. the confining stress $\sigma_0$ is "large"), the trajectory follows essentially the OM-edge, and then from the M-vertex remains within the MKK̃M̃-rectangle. Furthermore, the transition from O to M takes place extremely more rapidly than the evolution from the M to the K̃-vertex along a η-trajectory (or from M to the K-vertex if the rock is impermeable). In other words, the parametric space can be reduced to the MKK̃M̃-rectangle, and the lag can thus be neglected if φ<<1 and φ<<η. Through this reduction in the dimensions of the parametric space, the M-vertex becomes the apparent starting point of the evolution of a fluid-driven fracture without lag. The "penalty" for this reduction is a multiple boundary layer structure of the solution near the M-vertex.

Figure 5:
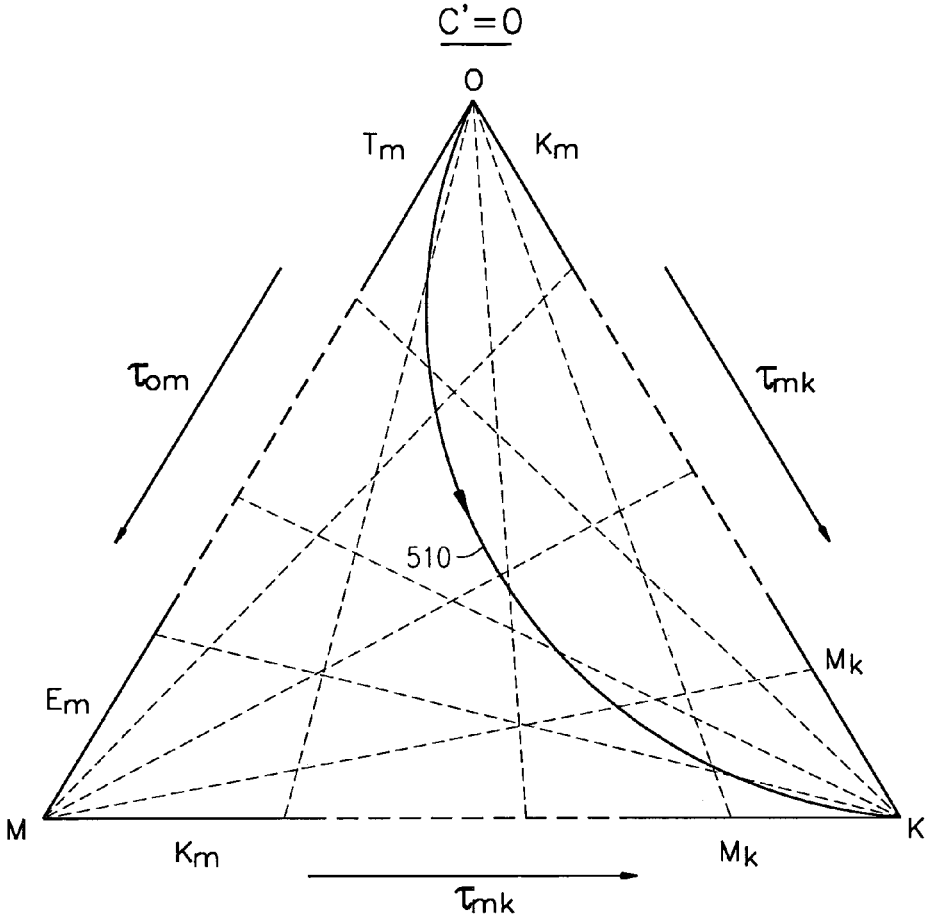
FIG. 5 shows a triangular parametric space.

If the rock is impermeable (C'=0), the solution is restricted to evolve on the MKO face of the parametric space (see FIG. 5), from O to K following a φ-trajectory 510. However, there is no additional time scale associated with the OK-edge and thus the transition OK takes place "rapidly" if φ>>1; this is a limiting case where the lag can be neglected, as the solution is always in the asymptotic K-regime.

2. Structure of the Solution Near the Tip of Propagating Hydraulic Fracture

The nature of the solution near the tip of a propagating fluid-driven fracture can be investigated by analyzing the problem of a semi-infinite fracture propagating at a constant speed V, see FIGS. 6 and 7. In the following, a distinction is made between regimes/scales with negligible and non-negligible lag between the crack tip and the fluid front. Although a lag of a prior unknown length λ between the crack tip and the fluid front must necessarily exist on a The singular integral equation $(13)_a$ derives from elasticity, while the Reynolds equation $(13)_b$ is deduced from the Poiseuille (q̂=ŵ³/μ'dp̂/dx̂), continuity (V dŵ/dx̂−dq̂/d x̂+ĝ=0), and Carter's leak-off laws (ĝ=C'√V/x̂). Equation $(13)_c$ expresses the crack propagation criterion, while the zero flow rate condition at the tip, $(13)_d$, arises from the assumption of zero lag.

Analogously to the considerations for the finite fracture, four primary limiting regimes of propagation of a semi-infinite fracture with zero lag can be identified where one of the two dissipative mechanisms and one of the two fluid storage components are vanishing: storage-viscosity (m), storage-toughness (k), leak-off-viscosity (m̃), and leak-off-toughness (k̃) dominated regimes. Each of the regimes correspond to the respective vertex of the rectangular parametric space of the semi-infinite fracture. However, in the context of the semi-infinite fracture, the storage-toughness (k) and leak-off-toughness (k̃) dominated regimes are identical since the corresponding zero viscosity (μ'=0) solution of (13) is independent of the balance between the fluid storage and leak-off, and is given by the classical linear elastic fracture mechanics (LEFM) solution ŵ=(K'/E')x̂$^{1/2}$ and p̂=0. Therefore, the toughness edge kk̃ of the rectangular parameteric space for the semi-infinite fracture collapses into a point, which can be identified with either k- or k̃-vertex, and the rectangular space itself into the triangular parametric space mkm̃, see FIG. 7.

The primary storage-viscosity, toughness, and leak-off-viscosity scalings associated with the three primary limiting regimes (m, k or k̃, and m̃) are as follows $$\hat{\xi}_{m,k,\tilde{m}} = \frac{\hat{x}}{l_{m,k,\tilde{m}}},\ \hat{\Omega}_{m,k,\tilde{m}} = \frac{\hat{w}}{l_{m,k,\tilde{m}}},\ \hat{\prod}_{m,k,\tilde{m}} = \frac{\hat{p}}{E'},\ \hat{\Psi}_{m,k,\tilde{m}} = \frac{\hat{q}}{V l_{m,k,\tilde{m}}} \tag{14}$$

where the three lengthscales $l_m$, $l_k$ and $l_{\tilde{m}}$ are defined as $l_m$=μ'V/E', $l_k$=(K'/E')², $l_{\tilde{m}=V}$$^{1/3}$(2μ'C')$^{2/3}$/E'$^{2/3}$. The solution $$F = \{\hat{\Omega}, \hat{\Pi}\}$$

in the various scalings can be shown to be of the form $\hat{F}_m(\hat{\xi}_m; c_m, k_m)$, $\hat{F}_k(\hat{\xi}_k; m_k, m_{\tilde{k}})$, $\hat{F}_{\tilde{m}}(\xi_{\tilde{m}}; s_{\tilde{m}}, k_{\tilde{m}})$, with the letters m's, k's, s's and c's representing dimensionless viscosity, toughness, storage, and leak-off coefficient, respectively.

$$k_m = m_k^{-1/2} = (l_k l_m)^{1/2},\ k_{\tilde{m}} = m_{\tilde{k}}^{-1/3} = (l_k l_{\tilde{m}})^{1/2},\ c_m = s_{\tilde{m}}^{-3/2} = (l_{\tilde{m}} l_m)^{3/2} \quad (15)$$

For example, a point in the mkm̃ ternary diagram corresponds to a certain pair $(k_m, c_m)$ in the viscosity scaling, with the m-vertex corresponding to $c_m=0$ and $k_m=0$. The vertex solutions (denoted by the subscript '0') are given by $$\hat{\Omega}_{m0} = \beta_{m0}\hat{\xi}_m^{2/3},\ \hat{\prod}_{m0} = \delta_{m0}\hat{\xi}_m^{-1/3}; \quad (16)$$

$$\hat{\Omega}_{k0} = \hat{\xi}_k^{1/2},\ \hat{\prod}_{k0} = 0;\ \text{and}$$

$$\hat{\Omega}_{\tilde{m}0} = \beta_{\tilde{m}0}\hat{\xi}_{\tilde{m}}^{5/8},\ \hat{\prod}_{\tilde{m}0} = \delta_{\tilde{m}0}\hat{\xi}_{\tilde{m}}^{-3/8}$$

with $\beta_{m0}=2^{1/3}3^{5/6}$, $\delta_{m0}=-6^{-2/3}$, $\beta_{\tilde{m}0}\cong 2.534$, $\delta_{\tilde{m}0}\cong -0.164$. Thus when there is only viscous dissipation (edge mm̃ corresponding to fracture propagation along preexisting discontiuity K'=0) the tip behavior is of the form $\hat{w}\sim\hat{x}^{2/3}$, $\hat{p}\sim-\hat{x}^{-1/3}$ in the storage-dominated case, m-vertex, (impermeable rock C'=0) and of the form $\hat{w}\sim\hat{x}^{5/8}$, $\hat{p}\sim-\hat{x}^{-3/8}$ in the leak-off dominated case, m̃-vertex. On the other hand, the k-vertex pertains to a fracture driven by an inviscid fluid (μ'=0); this vertex is associated with the classical tip solution of linear elastic fracture mechanics $\hat{w}\sim\hat{x}^{1/2}$. The general case of a fluid-driven fracture with no leak-off (C'=0) or negligible storage naturally corresponds to the mk- or m̃k-edges, respectively. However, a more general interpretation of the mkm̃ parametric space can be seen by expressing the numbers m's, k's, s's, and c's in terms of a dimensionless velocity ν, and a parameter $\hat{\eta}$ which only depends on the parameters characterizing the solid and the fluid $$v = \frac{l_m}{l_k} = \frac{V}{V_*},\ \hat{\eta} = \frac{l_m l_k^2}{l_{\tilde{m}}^3} = \frac{4E'^3\mu' C'^2}{K'^4} \quad (17)$$

where $V^*=K'^2/\mu'E$ is a characteristic velocity. Hence, $k_m=v^{-1/2}$, $k_{\tilde{m}}=\hat{\eta}^{-1/6}v^{-1/6}$, $c_m=\hat{\eta}^{1/2}v^{-1}$. The above expressions indicate that the solution moves from the m-vertex towards the k-vertex with decreasing dimensionless velocity ν, along a trajectory which depends only on $\hat{\eta}$. With increasing $\hat{\eta}$, the trajectory is pulled towards the m̃-vertex. Since the tip velocity of a finite fracture decreases with time (at least under constant injection rate), the tip solution interpreted from this stationary solution is seen to evolve with time. In other words, as the length scales $l_m$ and $l_{\tilde{m}}$ evolve with time, the nature of the solution in the tip region at a given physical scale evolves accordingly.

The solution along the edges of the mkm-triangle, namely, the viscosity mm-edge ($k_m=0$ or $k_{\tilde{m}}=0$), the storage mk-edge ($c_m=0$ or $m_{\tilde{k}}=0$), and the m̃k-edge ($s_{\tilde{m}}=0$ or $m_k=0$) has been obtained both in the form of series expansion in the neighborhood of the vertices and numerically for finite values of the non-zero parameters. These results were obtained in part by recognizing that the solution can be further resealed along each edge to eliminate the remaining parameter. For example, the tip solution along the mk-edge, which is governed by parameter $k_m$ in the m-scaling, upon rescaling to the mixed scaling can be expressed as $\hat{F}_{mk}(\hat{\xi}_{mk})$ where $\hat{\xi}_{mk}=\hat{x}/l_{mk}$ with $l_{mk}=l_k^3/l_m^2$.

The mm̃-, mk-, and m̃k-solutions obtained so far give a glimpse on the changing structure of the tip solution at various scales, and how these scales change with the problem parameters, in particular with the tip velocity ν. Consider for example the mk-solution (edge of the triangle corresponding to the case of impermeable rock) for the opening $\hat{\Omega}_{mk}(\hat{\xi}_{mk})$, with $\hat{\Omega}_{mk}=k_m^{-4}\hat{\Omega}_m=m_k\hat{\Omega}_k$. Expansion of the $\hat{\Omega}_{mk}$ at $\hat{\xi}_{mk}=0$ and at $\hat{\xi}_{mk}=\infty$ is of the form $$\hat{\Omega}_{mk} = \beta_{m0}\hat{\xi}_{mk}^{2/3} + \beta_{mk1}\hat{\xi}_{mk}^{h} + O(\hat{\xi}_{mk}^{-1/3})\ \text{at}\ \hat{\xi}_{mk}=\infty,\ \hat{\Omega}_{mk} = \hat{\xi}_{mk}^{1/2} + \beta_{km1}\hat{\xi}_{mk} + O(\hat{\xi}_{mk}^{3/2})\ \text{at}\ \hat{\xi}_{mk}=0 \quad (18)$$

The exponent h≅0.139 in the "alien" term $\hat{\xi}_{mk}^{h}$ of the far-field expansion $(18)_1$ is the solution of certain transcendental equation obtained in connection with corresponding boundary layer structure. In this case, the boundary layer arises because $\hat{w}\sim\hat{x}^{1/2}$ near $\hat{x}=0$ if K'>0, but $\hat{w}\sim\hat{x}^{2/3}$ when K'=0. The behavior of the mk-solution at infinity corresponds to the m-vertex solution. The mk-solution shows that $$\hat{\Omega}_{mk} \simeq \beta_{m0}\hat{\xi}_m^{2/3}$$

for $\hat{\xi}_{mk}>\hat{\xi}_{mk\infty}$, with $\hat{\xi}_{mk\infty}=O(1)$, with the consequence that there will be corresponding practical range of parameters for which the global solution for C'=0 is characterized by the m-vertex asymptotic behavior $\hat{w}\sim\hat{x}^{2/3}$, $\hat{p}\sim-\hat{x}^{-1/3}$ (viscous dissipation only), although $\hat{w}\sim\hat{x}^{1/2}$ in a very small region near the tip. Taking for example V≅1 m/s, E≅$10^3$ MPa, μ'≅$10^{-6}$ MPa·s, K'≅1 MPa·m$^{1/2}$, and C'=0, then $l_{mk}\cong 10^{-2}$ m. Hence, at distance larger than $10^{-2}$ m, the solution behaves as if the impermeable rock has no toughness and there is only viscous dissipation. As discussed further below, the m-vertex solution develops as an intermediate asymptote at some small distance from the tip in the finite fracture, provided the lengthscale $l_{mk}$ is much smaller than the fracture dimension R.

b. Regimes/scales with Non-negligible Fluid Lag.

The stationary problem of a semi-infinite crack propagating at constant velocity V is now considered, taking into consideration the existence of a lag of a priori unknown length λ between the crack tip and the fluid front, see FIG. 2. First, considerations are restricted to impermeable rocks. In this case, the tip cavity is filled with fluid vapors, which can be assumed to be at zero pressure.

This problem benefits from different scalings in part because the far-field stress $\sigma_o$, directly influences the solution, through the lag. Consider for example the mixed stress/storage/viscosity scaling (om)

$$\hat{\xi}_{om} = \frac{\hat{x}}{l_{om}} = \varepsilon^3\hat{\xi}_m,\ \hat{\Omega}_{om} = \varepsilon^2\hat{\Omega}_m,\ \widehat{\prod_{om}} = \varepsilon^{-1}\hat{\prod_m},\ \text{with } l_{om} = \varepsilon^{-3}l_m,\ \varepsilon = \frac{\sigma_o}{E'} \tag{19}$$

It can be shown that the solution is of the form $\hat{F}_{om}(\hat{\xi}_{om};k_{om})$, where $k_{om}=\epsilon^{1/2}k_m$ is the dimensionless toughness in this new scaling; $\hat{F}_{om}$ behaves according to the k-vertex asymptote near the tip $$\left(\hat{\Omega}_{om} \simeq k_{om}\hat{\xi}_{om}^{1/2} \text{ near } \hat{\xi}_{om} = 0\right)$$

and to the m-vertex asymptote far away from the tip $$\hat{\Omega}_{om} \simeq \beta_{om}\hat{\xi}_{om}^{2/3}$$

for $\hat{\xi}_{om}$>>1). The scaled lag $\lambda_{om}=\lambda/l_{om}$ continuously decreases with $k_{om}$, from a maximum value $\lambda_{mso}\cong 0.36$ reached either when K'=0 or $\sigma_o$=0. The decrease of $\lambda_{om}$ with $k_{om}$ becomes exponentially fast for large toughness (practically when $k_{om}\gtrsim 4$). Furthermore, analysis of the solution indicates that $\hat{F}_{om}(\hat{\xi}_{om};k_{om})$ can be rescaled into $\hat{F}_{mk}(\hat{\xi}_{mk})$ for large toughness ($k_{om}\gtrsim 4$)

$$\hat{\xi}_{mk} = k_{om}^{-6}\hat{\xi}_{om},\ \hat{\Omega}_{mk} = k_{om}^{-4}\hat{\Omega}_{om},\ \hat{\Pi}_{mk} = k_{om}^{2}\hat{\Pi}_{mk} \tag{20}$$

These considerations show that within the context of the stationary tip solution the fluid lag becomes irrelevant at the scales of interest if $k_{om}\gtrsim 4$, and can thus be assumed to be zero (with the implication that $\hat{q}$=0 at the tip, which leads to a singularity of the fluid pressure.) Also, the solution becomes independent of the far-field stress $\sigma_o$ when $k_{om}\gtrsim 4$ (except as a reference value of the fluid pressure) and it can be mapped within the mkm̃ parametric space introduced earlier.

In permeable rocks, pore fluid is exchanged between the tip cavity and the porous rock and flow of pore fluid within the cavity is taking place. The fluid pressure in the tip cavity is thus unknown and furthermore not uniform. Indeed, pore fluid is drawn in by suction at the tip of the advancing fracture, and is reinjected to the porous medium behind the tip, near the interface between the two fluids. (Pore fluid must necessarily be returning to the porous rock from the cavity, as it would otherwise cause an increase of the lag between the fracturing fluid and the tip of the fracture, and would thus eventually cause the fracture to stop propagating). Only elements of the solution for this problem exists so far, in the form of a detailed analysis of the tip cavity under the assumption that $\hat{w}\sim\hat{x}^{1/2}$ in the cavity.

This analysis shows that the fluid pressure in the lag zone can be expressed in terms of two parameters: a dimensionless fracture velocity $\bar{v}=V\lambda/c$ and a dimensionless rock permeability $\bar{\zeta}=kE'^3/(\lambda^{1/2}K'^3)$, where k and c denote respectively the intrinsic rock permeability and diffusivity. Furthermore, the solution is bounded by two asymptotic regimes: drained with the fluid pressure in the lag equilibrated with the ambient pore pressure $p_o$ ($\bar{v}$<<1 and $\bar{\zeta}$>>1), and undrained with the fluid pressure corresponding to its instantaneous (undrained) value at the moving fracture tip $$p_{f(tip)} = p_o - \frac{1}{2}\frac{K'}{E'}\frac{\mu_o}{k}\sqrt{\pi c V} \tag{21}$$

where $\mu_o$ is the viscosity of the pore fluid. The above expression for $p_{f(tip)}$ indicates that pore fluid cavitation can take place in the lag. Analysis of the regimes of solution suggests that the pore fluid pressure in the lag zone drop below cavitation limit in a wide range of parameters relevant for propagation of hydraulic fractures and magma dykes, implying a net-pressure lag condition identical to the one for impermeable rock. This condition allows one to envision the parametric space for the tip problem in the general case of the permeable rock (leak-off) and the lag (finiteness of the confining stress) as the pyramid mkm̃-oõ, where similarly to the case of the finite fracture, see FIG. 4, vertices o- and õ-correspond to the limits of storage and leak-off dominated cases under conditions of vanishing toughness and confining stress. The stationary tip solution near the om- and õm̃-edges behaves as k-vertex asymptote ($\hat{w}\sim\hat{x}^{1/2}$) near the tip and as the m-vertex ($\hat{w}\sim\hat{x}^{2/3}$) and m-vertex ($\hat{w}\sim\hat{x}^{5/8}$) asymptote, respectively, far away from the tip.

3. Local Tip and Global Structure of the Solution

The development of the general solution corresponding to the arbitrary η-trajectory in the MKK̃M̃ rectangle (or (η,φ)-trajectory in the MKK̃M̃-OÕ pyramid) is aided by understanding the asymptotic behavior of the solution in the vicinities of the rectangle (pyramid) vertices and edges. These asymptotic solutions can be obtained (semi-) analytically via regular or singular perturbation analysis. Construction of those solutions to the next order in the small parameter(s) associated with the respective edge (or vertex) can identify the physically meaningful range of parameters for which the fluid-driven fracture propagates in the respective asymptotic regime (and thus can be approximated by the respective edge (vertex) asymptotic solution). Since the solution trajectory evolves with time from M-vertex to the $\tilde{K}$-vertex inside of the MK$\tilde{K}\tilde{M}$-rectangle (or generally, from the O-vertex to the $\tilde{K}$-vertex inside of the MK$\tilde{K}\tilde{M}$-O$\tilde{O}$ pyramid), it is helpful to have valid asymptotic solutions developed in the vicinities of these vertices. The solution in the vicinity of the some of the vertices (e.g., O, K, and $\tilde{K}$) is a regular perturbation problem, which has been solved for the K-vertex along the MK- and KO-edge of the pyramid. The solution in the vicinity of the M-vertex is challenging since it constitutes a singular perturbation problem for a system of non-linear, non-local equations in more than one small parameter, namely, $K_m$ (along the MK-edge), $C_m$ (along the MM-edge), and, generally, $E_m=T_m^{-1}$ (along the MO-edge), given that the nature of the tip singularity changes with a small perturbation from zero in any of these parameters. Indeed, solution at M-vertex is given by the zero-toughness ($K_m=0$), zero leak-off ($C_m=0$), zero-lag ($E_m=T_m^{-1}=0$) solution which near tip behavior is given by the m-vertex tip solution, $\Omega_m\sim(1-\rho)^{2/3}$ and $\Pi_m\sim-(1-\rho)^{-1/3}$. Small perturbation of the M-vertex in either toughness $K_m$, or leak-off $C_m$, or lag $E_m$ changes the nature of the near tip behavior to either the toughness asymptote $\Omega_m\sim(1-\rho)^{1/2}$, or the leak-off asymptote $\Omega_m\sim(1-\rho)^{5/8}$, or the lag asymptote $\Omega_m\sim(1-\rho)^{3/2}$, respectively. This indicates the emergence of the near tip boundary layer (BL) which incorporates arising toughness singularity and/or leak-off singularity and/or the fluid lag. If the perturbation is small enough, there exists a lengthscale intermediate to the fracture length and the BL "thickness" where the outer solution (i.e. the solution away from the fracture tip) and the BL solution (given by the stationary tip solution discussed above) can be matched to form the composite solution uniformly valid along the fracture. Matching requires that the asymptotic expansions of the outer and the BL solutions over the intermediate lengthscale are identical.

As an illustration, the non-trivial structure of the global solution in the vicinity of the M-vertex along the MK-edge (i.e., singular perturbation problem in $K_m$, while $C_m=E_m=0$) is now outlined, corresponding to the case of a fracture in impermeable rock and large confining stress (or time). The outer expansion for $\Omega$, $\Pi$, and dimensionless fracture radius $\gamma$ are perturbation expansions in powers of $$K_m^b,$$

b>0. Here the matching not only gives the coefficients in the expansion, but also determines the exponent b. It can be shown that the tip solution along the mk-edge (18) corresponds to the O(1) term in the inner (boundary layer) expansion at the tip. The inner and outer (global) scaling for the radial fracture are related as $$1-\rho=\frac{81}{16\gamma_{mO}^3}K_m^6\hat{\xi}_{mk},\ \Omega_m=\frac{9}{4\gamma_{mO}}K_m^4\hat{\Omega}_{mk},\ \Pi_m=\frac{4\gamma_{mO}}{9}K_m^{-2}\hat{\Pi}_{mk} \tag{22}$$

where $\gamma_{mO}$ is the O(1) term of the outer expansion for $\gamma$ given by the M-vertex solution ($K_m=C_m=E_m=0$). Using the asymptotic expression (18) together with the scaling (22), one finds that the outer and inner solutions match under the condition $$K_m^6\ll 1.$$

Then the leading order inner and outer solutions form a single composite solution of O(1) uniformly valid along the fracture. That is, to leading order there is a lengthscale intermediate to the tip boundary layer thickness $$K_m^6 R$$

R and the fracture radius R, over which the inner and outer solutions posses the same intermediate asymptote, corresponding to the m-vertex solution $(16)_1$. This solution structure corresponds to the outer zero-toughness solution valid on the lengthscale of the fracture, and thin tip boundary layer given by the mk-edge solution.

To leading order the condition $$K_m^6\ll 1$$

is merely a condition for the existence of the boundary layer solution. In order to move away from the M-vertex solution away from the tip, one has to determine the exponent b in the next term in the asymptotic expansion. From this value of b we determine the asymptotic validity of the approximation. This can be obtained from the next-order matching between the near tip asymptote in the outer expansion and the away from tip behavior of the inner solution, see (18). Here the matching to the next order of the outer and inner solutions does not require the next-order inner solution, as the next order outer solution is matched with the leading order term of the inner solution. The latter appears to be a consequence of the non-local character of the perturbation problem. Then using (18) an expression for the exponent b=4−6h is obtained which yields b≅3.18 and consequently the next order contribution in the asymptotic expansion away from the tip. The range of dimensionless toughness in which fracture global (outer) solution can be approximated by the M-vertex solution is, therefore, given by $$K_m^{3.18}\ll 1.$$

B. Plane Strain (KGD) Fractures

Figure 8:
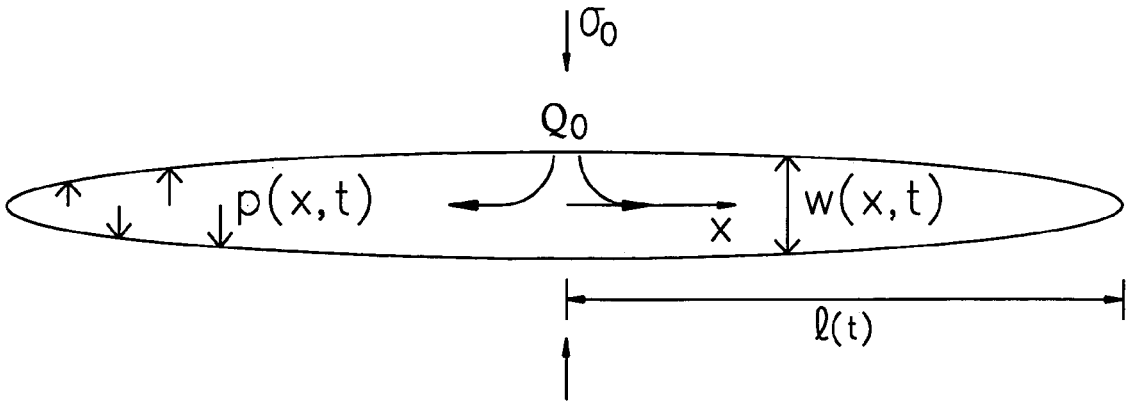
FIG. 8 shows a plane strain hydraulic fracture.

The problem of a KGD hydraulic fracture driven by injecting a viscous fluid from a "point"-source, at a constant volumetric rate $Q_o$ is schematically shown in FIG. 8. Under conditions where the lag is negligible, determining the solution of this problem consists of finding the aperture w of the fracture, and the net pressure p (the difference between the fluid pressure $p_f$ and the far-field stress $\sigma_o$) as a function of both the coordinate x and time t, as well as the evolution of the fracture radius l(t). The functions l(t), w(x,t), and p(x,t) depend on the injection rate $Q_o$ and on the 4 material parameters E', μ', K', and C' respectively defined as $$E' = \frac{E}{1-\nu^2} \quad \mu' = 12\mu \quad K' = 4\left(\frac{2}{\pi}\right)^{1/2} K_{Ic} \quad C' = 2C_l \tag{23}$$

The three functions l(t), w(x,t), and p(x,t) are determined by solving a set of equations which can be summarized as follows.

Elasticity Equation:

$$p(x,t) = -\frac{E'}{4\pi}\int_{-l}^{l}\frac{\partial w(s,t)}{\partial s}\frac{ds}{s-x} \tag{24}$$

This singular integral equation expresses the non-local dependence of the fracture width w on the net pressure p.

Lubrication Equation:

$$\frac{\partial w}{\partial t} + g = \frac{1}{\mu'}\frac{\partial}{\partial x}\left(w^3\frac{\partial p}{\partial x}\right) \tag{25}$$

This non-linear differential equation governs the flow of viscous incompressible fluid inside the fracture. The function g(x,t) denotes the rate of fluid leak-off, which evolves according to $$g = \frac{C'}{\sqrt{t - t_o(x)}} \tag{26}$$

where $t_o(x)$ is the exposure time of point x (i.e., the time at which the fracture front was at a distance x from the injection point).

Global Volume Balance:

$$Q_o t = 2\int_0^l w\,dx + 2\int_0^t\int_0^{l(\tau)} g(x,\tau)\,dx\,d\tau \tag{27}$$

This equation expresses that the total volume of fluid injected is equal to the sum of the fracture volume and the volume of fluid lost in the rock surrounding the fracture.

Propagation Criterion:

$$w \simeq \frac{K'}{E'}\sqrt{l-x}, \quad 1-\frac{x}{l} << 1 \tag{28}$$

Within the framework of linear elastic fracture mechanics, this equation embodies the fact that the fracture is always propagating and that energy is dissipated continuously in the creation of new surfaces in rock (at a constant rate per unit surface). Note that (28) implies that w=0 at the tip.

Tip Conditions:

$$w^3\frac{\partial p}{\partial x} = 0, \quad x = l \tag{29}$$

This zero fluid flow rate condition (q=0) at the fracture tip is applicable only if the fluid is completely filling the fracture (including the tip region) or if the lag is negligible at the scale of the fracture.

1. Propagation Regimes of a KGD Fracture

Propagation of a hydraulic fracture with zero lag is governed by two competing dissipative processes associated with fluid viscosity and solid toughness, respectively, and two competing components of the fluid balance associated with fluid storage in the fracture and fluid storage in the surrounding rock (leak-off). Consequently, the limiting regimes of propagation of a fracture can be associated with the dominance of one of the two dissipative processes and/or the dominance of one of the two fluid storage mechanisms. Thus, four primary asymptotic regimes of hydraulic fracture propagation with zero lag can be identified where one of the two dissipative mechanisms and one of the two fluid storage components are vanishing: storage-viscosity (M), storage-toughness (K), leak-off-viscosity ($\tilde{M}$), and leak-off-toughness ($\tilde{K}$) dominated regimes. For example, fluid leak-off is negligible compared to the fluid storage in the fracture and the energy dissipated in the flow of viscous fluid in the fracture is negligible compared to the energy expended in fracturing the rock in the storage-viscosity-dominated regime (M). The solution in the storage-viscosity-dominated regime is given by the zero-toughness, zero-leak-off solution (K'=C'=0).

Consider the general scaling of the finite fracture, which hinges on defining the dimensionless crack opening Ω, net pressure Π, and fracture radius γ as $$w=\epsilon L\Omega(\xi;P_1,P_2),\ p=\epsilon E'\Pi(\xi;P_1,P_2),\ l=\gamma(P_1,P_2)L \tag{30}$$

With these definitions, we have introduced the scaled coordinate $\xi = x/l(t)$ ($0 \leqq \xi \leqq 1$), a small number $\epsilon(t)$, a length scale L(t) of the same order of magnitude as the fracture length l(t), and two dimensionless evolution parameters $P_1(t)$ and $P_2(t)$, which depend monotonically on t. The form of the scaling (30) can be motivated from elementary elasticity considerations, by noting that the average aperture scaled by the fracture length is of the same order as the average net pressure scaled by the elastic modulus.

Four different scalings can be defined to emphasize above different primary limiting cases. These scalings yield power law dependence of L, $\epsilon$, $P_1$, and $P_2$ on time t; i.e. $L \sim t^{\alpha}$, $\epsilon \sim t^{\delta}$, $P_1 \sim t^{\beta_2}$, $P_2 \sim t^{\beta_2}$, see Table 2 for the case of a radial fracture. Furthermore, the evolution parameters can take either the meaning of a toughness ($K_m$, $K_{\tilde{m}}$), or a viscosity ($M_k$, $M_{\tilde{k}}$), or a storage ($S_{\tilde{m}}$, $S_{\tilde{k}}$), or a leak-off coefficient ($C_m$, $C_k$).

TABLE 2

Small parameter $\epsilon$, lengthscale L, and parameters $P_1$ and $P_2$ for the two storage scalings (viscosity and toughness) and the two leak-off scalings (viscosity and toughness).

| Scaling | $\epsilon$ | L | $P_1$ | $P_2$ |
|---|---|---|---|---|
| storage/ viscosity(M) | $\left(\frac{\mu'}{E't}\right)^{1/3}$ | $\left(\frac{E'Q_o^3t^4}{\mu'}\right)^{1/6}$ | $K_m = K'\left(\frac{1}{E'^3\mu'Q_o}\right)$ | $C_m = C'\left(\frac{E't}{\mu'Q_o^3}\right)^{1/6}$ |
| storage/ toughness(K) | $\left(\frac{K'^4}{E'^4Q_ot}\right)^{1/3}$ | $\left(\frac{E'Q_ot}{K'}\right)^{2/3}$ | $M_k = \mu'\left(\frac{E'^3Q_o}{K'^4}\right)$ | $C_k = C'\left(\frac{E'^4t}{K'^4Q_o^2}\right)^{1/6}$ |
| leak-off/ viscosity(M) | $\left(\frac{\mu'C'^2}{E'Q_ot}\right)^{1/4}$ | $\frac{Q_ot^{1/2}}{C'}$ | $K_{\tilde{m}} = K_m$ | $S_{\tilde{m}} = \left(\frac{\mu'Q_o^3}{E'C'^6t}\right)^{1/4}$ |
| leak-off/ toughness(K) | $\left(\frac{K'^4C'^2}{E'^4Q_o^2t}\right)^{1/4}$ | $\frac{Q_ot^{1/2}}{C'}$ | $M_{\tilde{k}} = M_k$ | $S_{\tilde{k}} = \left(\frac{K'^4Q_o^2}{E'^4C'^6t}\right)^{1/4}$ |

Figure 9:
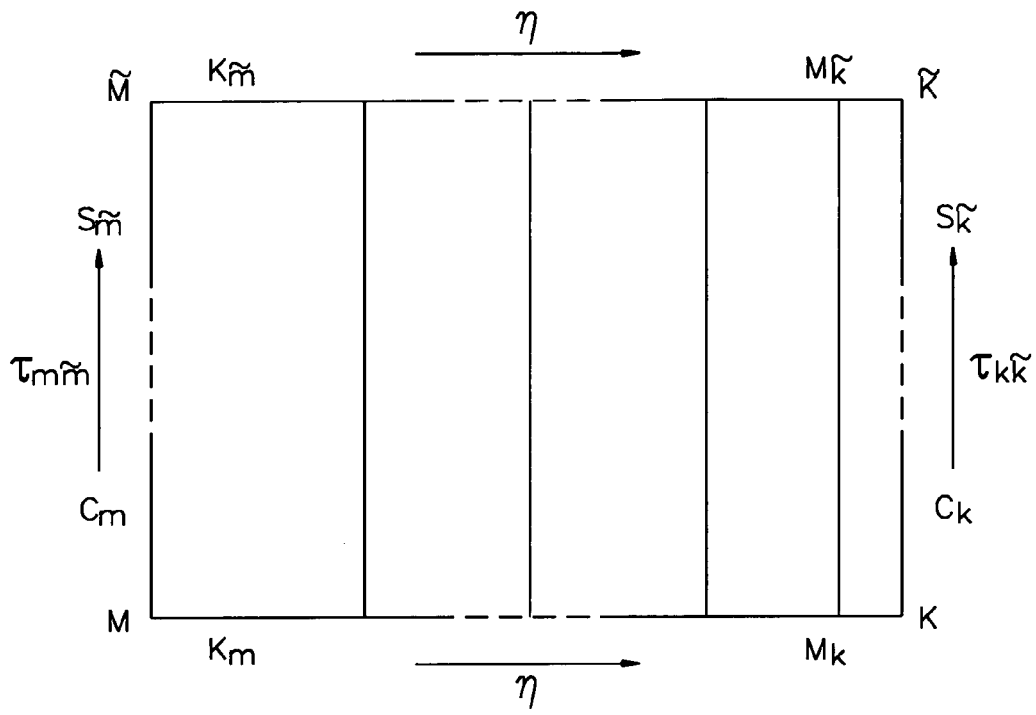
FIG. 9 shows another rectangular parametric space.

The regimes of solutions can be conceptualized in a rectangular phase diagram MK$\tilde{K}\tilde{M}$ shown in FIG. 9. Each of the four primary regimes (M, K, $\tilde{M}$, and $\tilde{K}$) of hydraulic fracture propagation corresponding to the vertices of the diagram is dominated by only one component of fluid global balance while the other can be neglected (i.e. respective $P_1$=0, see Table 1) and only one dissipative process while the other can be neglected (i.e. respective $P_2$=0, see Table 1). As follows from the stationary tip solution, the behavior of the solution at the tip also depends on the regime of solution: $\Omega\sim(1-\rho)^{2/3}$ at the M-vertex, $\Omega\sim(1-\rho)^{5/8}$ at the $\tilde{M}$-vertex, and $\Omega\sim(1-\rho)^{1/2}$ at the K- and $\tilde{K}$-vertices.

The edges of the rectangular phase diagram MK$\tilde{K}\tilde{M}$ can be identified with the four secondary limiting regimes corresponding to either the dominance of one of the two fluid global balance mechanisms or the dominance of one of the two energy dissipation mechanisms: storage-edge (MK, $C_m=C_k=0$), leak-off-edge ($\tilde{M}\tilde{K}$, $S_{\tilde{m}}=S_{\tilde{k}}=0$), viscosity-edge (M $\tilde{M}$, $K_m=K_{\tilde{m}}=0$), and K$\tilde{K}$-toughness-edge ($M_k=M_{\tilde{k}}=0$). The solution along the storage-edge MK and along the leak-off-edge $\tilde{M}\tilde{K}$ has the property that it evolves with time t according to a power law, i.e., according to $l\sim t^{\alpha}$ where the exponent $\alpha$ depends on the regime of propagation: $\alpha$=2/3 on the storage-edge MK and $\alpha$=1/2 on leak-off-edge $\tilde{M}\tilde{K}$.

The regime of propagation evolves with time from the storage-edge to the leak-off edge since the parameters C's and S's depend on t, but not K's and M's. With respect to the evolution of the solution in time, it is useful to locate the position of the state point in the MK$\tilde{K}\tilde{M}$ space in terms of $\eta$ which is a power of any of the parameters K's and M's and a dimensionless time, either $\tau_{m\tilde{m}}=t/t_{m\tilde{m}}$ *or* $\tau_{k\tilde{k}=t/t_{k\tilde{k}}}$ *where*

$$\eta = \frac{K'^4}{E'^3\mu'Q_o},\ t_{m\tilde{m}} = \frac{\mu'Q_o^3}{E'C'^6},\ t_{k\tilde{k}} = \frac{K'^4Q_o^2}{E'^4C'^6} \tag{31}$$

also noting that $\tau_{m\tilde{m}}=\eta t_{k\tilde{k}}$ *since*

$$\frac{t_{k\tilde{k}}}{t_{m\tilde{m}}} = \eta \tag{32}$$

The parameters M's, K's, C's and S's can be expressed in terms of $\eta$ and $\tau_{m\tilde{m}}$*(or* $\tau_{k\tilde{k}}$*) according to*

$$K_m=K_{\tilde{m}}=\eta^{1/4},\ M_k=M_{\tilde{k}}=\eta^{-1} \tag{33}$$

$$C_m = \tau_{m\tilde{m}}^{1/6},\ C_k = \eta^{-1/6}\tau_{m\tilde{m}}^{1/6} = \tau_{k\tilde{k}}^{1/6} \tag{34}$$

$$S_{\tilde{m}} \approx \tau_{m\tilde{m}}^{\frac{1}{4}},\ S_{\tilde{k}} = \eta^{\frac{1}{4}}\tau_{m\tilde{m}}^{-\frac{1}{4}} = \tau_{k\tilde{k}}^{-\frac{1}{4}} \tag{35}$$

A point in the parametric space MK$\tilde{K}\tilde{M}$ is thus completely defined by $\eta$ and any of these two times. The evolution of the state point can be conceptualized as moving along a trajectory perpendicular to the storage- or the leak-off-edge.

In summary, the MK-edge corresponds to the origin of time, and the $\tilde{M}\tilde{K}$-edge to the end of time (except in impermeable rocks). Thus, given all the problem parameters which completely define the number $\eta$, the system evolves with time (e.g., time $\tau_{mk}$) along a $\eta$-trajectory, starting from the MK-edge ($C_m=C_k=0$) and ending at the $\tilde{M}\tilde{K}$-edge ($S_{\tilde{k}}=S_{\tilde{m}}=0$). If $\eta$=0, the fluid is inviscid ($\mu'$=0) and the system then evolves along the toughness-edge from K to $\tilde{K}$. If $\eta=\infty$, then K'=0 the system evolves along the viscosity-edge from M to $\tilde{M}$; The dependence of the scaled solution F can thus be expressed in the form $F(\xi;\tau;\eta)$, where $\tau$ is one of the dimensionless time, irrespective of the adopted scaling.

II. Embodiments Utilizing a Second Parametric Space

A. Radial Fractures

Determining the solution of the problem of a radial hydraulic fracture propagating in a permeable rock consists of finding the aperture w of the fracture, and the net pressure p (the difference between the fluid pressure $p_f$ and the far-field stress $\sigma_o$) as a function of both the radial coordinate r and time t, as well as the evolution of the fracture radius R(t). The functions R(t), w(r,t), and p(r,t) depend on the injection rate $Q_o$ and on the four material parameters E', $\mu'$, K', and C' respectively defined as $$E' = \frac{E}{1-\nu^2} \quad \mu' = 12\mu \quad K' = 4\left(\frac{2}{\pi}\right)^{\frac{1}{2}} K_{Ic} \quad C' = 2C_l \tag{36}$$

The three functions R(t), w(r,t), and p(r,t) are determined by solving a set of equations which can be summarized as follows.

Elasticity Equation $$w = \frac{R}{E'}\int_0^1 G(r/R, s)p(sR, t)s\,ds \tag{37}$$

where G is a known elastic kernel. This singular integral equation expresses the non-local dependence of the fracture width w on the net pressure p.

Lubrication Equation $$\frac{\partial w}{\partial t} + g = \frac{1}{\mu'}\frac{1}{r}\frac{\partial}{\partial r}\left(rw^3\frac{\partial p}{\partial r}\right) \tag{38}$$

This non-linear differential equation governs the flow of viscous incompressible fluid inside the fracture. The function g(r,t) denotes the rate of fluid leak-off, which evolves according to Carter's law $$g = \frac{C'}{\sqrt{t - t_o(r)}} \tag{39}$$

where $t_o(r)$ is the exposure time of point r (i.e., the time at which the fracture front was at a distance r from the injection point).

Global Volume Balance $$Q_o t = 2\pi\int_0^R wr\,dr + 2\pi\int_0^t r\int_0^{R(\tau)} g(r,\tau)\,dr\,d\tau \tag{40}$$

This equation expresses that the total volume of fluid pumped is equal to the sum of the fracture volume and the volume of fluid lost in the rock surrounding the fracture.

Propagation Criterion $$w \simeq \frac{K'}{E'}\sqrt{R-r}, \quad 1 - \frac{r}{R} \ll 1 \tag{41}$$

Within the framework of linear elastic fracture mechanics, this equation embodies fact that the fracture is always propagating and that energy is dissipated continuously in the creation of new surfaces in rock (at a constant rate per unit surface)

Tip Conditions $$w=0, \quad w^3\frac{\partial p}{\partial r} = 0, \quad r=R \tag{42}$$

The tip of the propagating fracture corresponds to a zero width and to a zero fluid flow rate condition.

1. Scalings

The general solution of this problem (which includes understanding the dependence of the solution on all the problem parameters) can be considerably simplified through the application of scaling laws. Scaling of this problem hinges on defining the dimensionless crack opening Ω, net pressure Π, and fracture radius γ as $$w=\epsilon L\Omega(\rho;P_1,P_2),\ p=\epsilon E\Pi(\rho;P_1,P_2),\ R=\gamma(P_1,P_2)L \tag{43}$$

These definitions introduce the scaled coordinate ρ=r/R(t) (0≦ρ≦1), a small number ϵ(t), a length scale L(t) of the same order of magnitude as the fracture length R(t), and two dimensionless evolution parameters $P_1(t)$ and $P_2(t)$, which depend monotonically on t. As is shown below, three different scalings ("viscosity", "toughness," and "leak-off") can be defined, which yield power law dependence of L, ϵ, $P_1$, and $P_2$ on time t; i.e. $L\sim t^{\alpha}$, $\epsilon\sim t^{\delta}$, $P_1\sim t^{\beta_1}$, $P_2\sim t^{\beta_2}$. The form of the scaling (43) can be motivated from elementary elasticity considerations, by noting that the average aperture scaled by the fracture radius is of the same order as the average net pressure scaled by the elastic modulus.

The main equations are transformed as follows, under the scaling (43).

Elasticity Equation $$\Omega = \gamma\int_0^1 G(\rho, s)\Pi(s;P_1, P_2)s\,ds \tag{44}$$

Lubrication Equation:

$$\left(\frac{\dot{\epsilon}t}{\epsilon} + \frac{\dot{L}t}{L}\right)\Omega - \frac{\dot{L}t}{L}\rho\frac{\partial\Omega}{\partial\rho} + \dot{P}_1 t\left(\frac{\partial\Omega}{\partial P_1} - \frac{\rho}{\gamma}\frac{\partial\gamma}{\partial P_1}\frac{\partial\Omega}{\partial\rho}\right) + \dot{P}_2 t\left(\frac{\partial\Omega}{\partial P_2} - \frac{\rho}{\gamma}\frac{\partial\gamma}{\partial P_2}\frac{\partial\Omega}{\partial\rho}\right) + G_c\Gamma = \frac{1}{G_m\gamma^2\rho}\frac{\partial}{\partial\rho}\left(\rho\Omega^3\frac{\partial\Pi}{\partial\rho}\right) \tag{45}$$

where the leak-off function $\Gamma(\rho;P_1,P_2)$ is defined as $$\Gamma(\rho; P_1, P_2) = \frac{1}{\sqrt{1 - t_o/t}},$$

$t>t_o$

Global Mass Balance $$2\pi\gamma^2\int_0^1 \Omega\rho\, d\rho + \tag{46}$$

$$2\pi G_c\int_0^1 u^{2\alpha-1/2}\gamma^2(u^{\beta_1}P_1, u^{\beta_2}P_2)I(u^{\beta_1}P_1, u^{\beta_2}P_2)du\, du = G_v$$

where I is given by $$I(X_1, X_2) = \int_0^1 \Gamma(\rho; X_1, X_2)\rho\, d\rho$$

Propagation Criterion $$\Omega = G_k\gamma^{1/2}(1-\rho)^{1/2}1-\rho<<1 \tag{47}$$

Four dimensionless groups $G_v$, $G_m$, $G_k$, $G_c$ appear in these equations:

$$G_v = \frac{Q_o t}{\varepsilon L^3},\ G_m = \frac{\mu'}{\varepsilon^3 E' t},\ G_k = \frac{K'}{\varepsilon E' L^{1/2}},\ G_c = \frac{C' t^{1/2}}{\varepsilon L} \tag{48}$$

While the group $G_v$ is associated with the volume of fluid pumped, $G_m$, $G_k$, and $G_c$ can be interpreted as dimensionless viscosity, toughness, and leak-off coefficients, respectively. Three different scalings can be identified, with each scaling leading to a different definition of the set $\epsilon$, L, $P_1$, and $P_2$. Each scaling is obtained by setting $G_v=1$ and one of the other groups to 1 ($G_m$ for the viscosity scaling, $G_k$ for the toughness scaling, and $G_c$ for the leak-off scaling), with the two other groups being identified as $P_1$ and $P_2$. Three scalings denoted as viscosity, toughness, and leak-off can thus be defined depending on whether the group containing μ' ($G_m$), K' ($G_k$) or C' ($G_c$) is set to 1. The three scalings are summarized in Table 3.

TABLE 3

Small parameter $\epsilon$, lengthscale L, and parameters $P_1$ and $P_2$ for the viscosity, toughness, and leak-off scaling.

| Scaling | $\epsilon$ | L | $P_1$ | $P_2$ |
|---|---|---|---|---|
| Viscosity | $\left(\frac{\mu'}{E't}\right)^{1/3}$ | $\left(\frac{E'Q_o^3t^4}{\mu'}\right)^{1/9}$ | $K_m = K'\left(\frac{t^2}{\mu'^5E'^{13}Q_o^3}\right)^{1/18}$ | $C_m = C'\left(\frac{E'^3t^7}{\mu'^4Q_o^6}\right)^{1/18}$ |
| Toughness | $\left(\frac{K'^6}{E'^6Q_o t}\right)^{1/5}$ | $\left(\frac{E'Q_o t}{K'}\right)^{2/5}$ | $M_k = \mu'\left(\frac{Q_o^3E'^{13}}{K'^{18}t^2}\right)^{1/5}$ | $C_k = C'\left(\frac{E'^8t^3}{K'^8Q_o^2}\right)^{1/10}$ |
| Leak-off | $\left(\frac{C'^6t}{Q_o^2}\right)^{1/4}$ | $M_k = \mu'\left(\frac{E'^{12}C'^2Q_o^2}{K'^{16}t}\right)^{1/4} = K'\left(\frac{Q_o^2}{E'^8C'^{10}t^3}\right)^{1/8}$ | | $M_c = \mu'\left(\frac{Q_o^6}{E'^4C'^{18}t^7}\right)^{1/4}$ |

Figure 10:
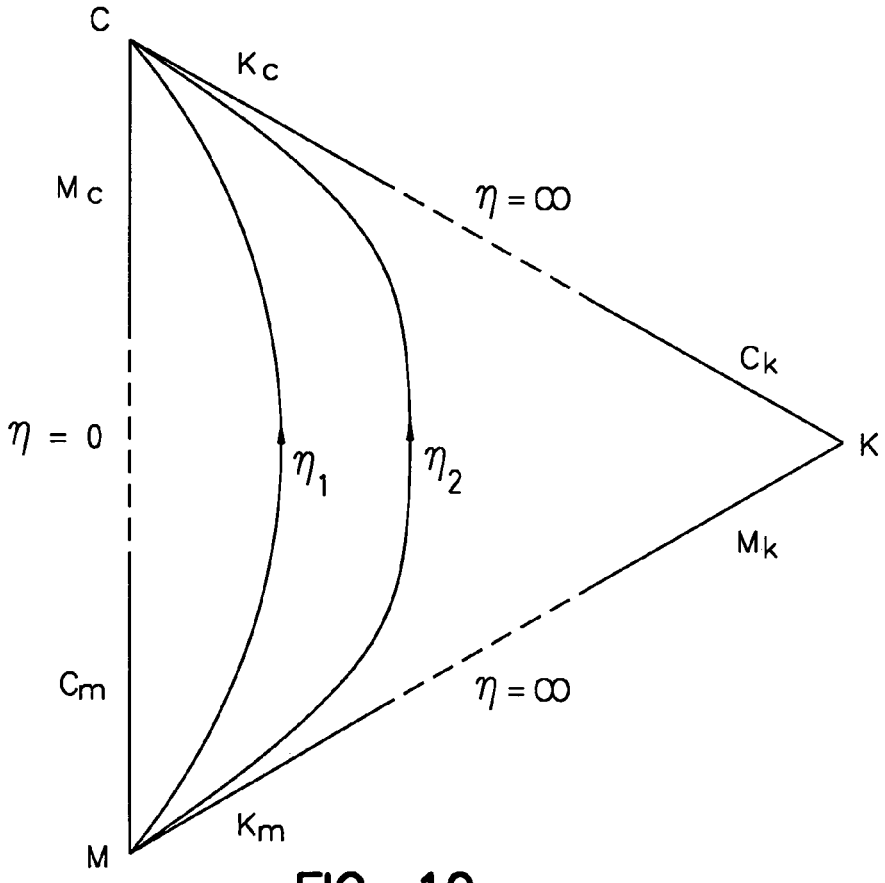
FIG. 10 shows a triangular parametric space with two trajectories.

The evolution of the radial fracture can be conceptualized in the ternary phase diagram MKC shown in FIG. 10. First, however, the dimensionless number η and time τ are introduced as $$\eta = \frac{K'^{14}}{E'^{11}\mu'^3C'^4Q_o},\ \tau = \frac{t}{t_{cm}},\ \text{with}\ t_{cm} = \left(\frac{\mu'^4Q_o^6}{E'^4C'^{18}}\right)^{1/7} \tag{49}$$

As shown in Table 3, the evolution parameters $P_1$ and $P_2$ in the three scalings can be expressed in terms of η and τ only. Both $K_m$ and $C_m$ are positive power of time τ, while $K_c$ and $M_c$ are negative power of τ; furthermore, $M_k \sim \tau^{-2/5}$ and $C_k \sim \tau^{3/10}$. Hence, the viscosity scaling is appropriate for small time, while the leak-off scaling is appropriate for large time. The toughness scaling applies to intermediate time when both $M_k$ and $C_k$ are o(1).

TABLE 4

Dependence of the parameters $P_1$ and $P_2$ on the dimensionless time τ and number η for the viscosity, toughness, and leak-off scaling.

| Scaling | $P_1$ | $P_2$ |
|---|---|---|
| Viscosity | $K_m = \eta^{1/14}\tau^{1/9}$ | $C_m = \tau^{7/18}$ |
| Toughness | $C_k = \eta^{-2/35}\tau^{3/10}$ | $M_k = \eta^{-9/35}\tau^{-2/5}$ |
| Leak-off | $M_c = \tau^{-7/4}$ | $K_c = \eta^{1/14}\tau^{-3/8}$ |

The solution of a hydraulic fracture starts at the M-vertex ($K_m$=0, $C_m$=0) and ends at the C-vertex ($M_c$=0, $K_c$=0); it evolves with time τ, along a trajectory which is controlled only by the number η, a function of all the problem parameters (i.e., $Q_o$, E', μ', K', and C'). If η=0 (the rock has zero toughness), the evolution from M to C is done directly along the base MC of the ternary diagram MKC. With increasing η (which can be interpreted for example as increasing relative toughness, the trajectory is pulled towards the K-vertex. For η=∞, two possibilities exist: either the rock is impermeable (C'=0) and the system evolves directly from M to K, or the fluid is inviscid and the system then evolves from K to C.

At each corner of the MKC diagram, there is only one dissipative mechanism at work; for example, at the M-vertex, energy is only dissipated in viscous flow of the fracturing fluid since the rock is assumed to be impermeable and to have zero toughness. It is interesting to note that the mathematical solution is characterized by a different tip singularity at each corner, reflecting the different nature of the dissipative mechanism.

M-corner:

$$\Omega \sim (1-\rho)^{2/3}\ \Pi \sim (1-\rho)^{-1/3} \text{ for } \rho \sim 1 \tag{50}$$

C-corner:

$$\Omega \sim (1-\rho)^{5/8}\ \Pi \sim (1-\rho)^{-3/8} \text{ for } \rho \sim 1 \tag{51}$$

K-corner:

$$\Omega \sim (1-\rho)^{1/2}\ \Pi \sim \text{Const for } \rho \sim 1 \tag{52}$$

The transition of the solution in the tip region between two corners can be analyzed by considering the stationary solution of a semi-infinite hydraulic fracture propagating at constant speed.

2. Applications of the Scaling Laws

The dependence of the scaled solution $F=\{\Omega,\Pi,\gamma\}$ is thus of the form $F(\rho,\tau;\eta)$, irrespective of the adopted scaling. In other words, the scaled solution is a function of the dimensionless spatial and time coordinates $\rho$ and $\tau$, which depends only on $\eta$, a constant for a particular problem. Thus the laws of similitude between field and laboratory experiments simply require that $\eta$ is preserved and that the range of dimensionless time $\tau$ is the same—even for the general case when neither the fluid viscosity, nor the rock toughness, nor the leak-off of fracturing fluid in the reservoir can be neglected.

Figure 11:
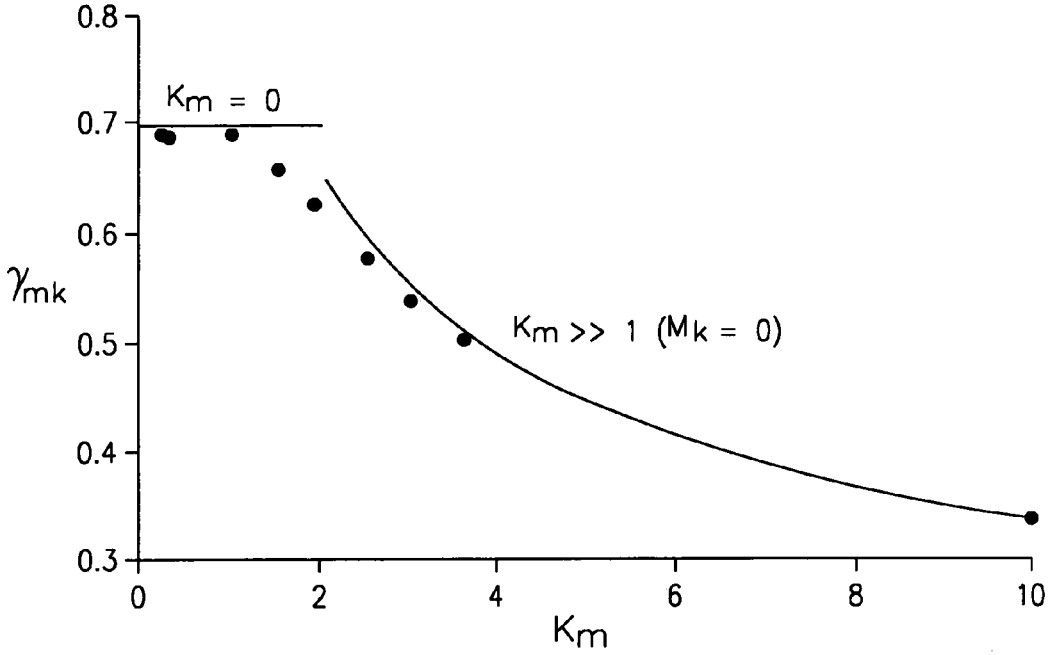
FIG. 11 shows a graph illustrating the dependence of a dimensionless fracture radius on a dimensionless toughness.

Although the solution in any scaling can readily be translated into another scaling, each scaling is useful because it is associated with a particular process. Furthermore, the solution at a corner of the MKC diagram in the corresponding scaling (i.e., viscosity at M, toughness at K, and leak-off at C) is self-similar. In other words, the scaled solution at these vertices does not depend on time, which implies that the corresponding physical solution (width, pressure, fracture radius) evolves with time according to a power law. This property of the solution at the corners of the MKC diagram is important, in part because hydraulic fracturing near one comer is completely dominated by the associated process. For example, in the neighborhood of the M-corner, the fracture propagates in the viscosity-dominated regime; in this regime, the rock toughness and the leak-off coefficient can be neglected, and the solution in this regime is given for all practical purposes by the zero-toughness, zero-leak-off solution at the M-vertex. Findings from work along the MK edge where the rock is impermeable suggest that the region where only one process is dominant is surprising large. FIG. 11 shows the variation of $\gamma_{mk}$ (the fracture radius in the viscosity scaling) with the dimensionless toughness $K_m$ for an impermeable rock ($K_m=0$ corresponds to the M-vertex, $K_m=\infty$ (i.e., $M_c=0$) to the K-vertex). These results indicate that a hydraulic fracture propagating in an impermeable rock is in the viscosity-dominated regime if $K_m<K_{mm}\cong 1$, and in the toughness-dominated regime if $K_m>K_{mk}\cong 4$.

Accurate solutions can be obtained for a radial hydraulic fracture propagating in regimes corresponding to the edges MK, KC, and CM of the MKC diagram. These solutions enable one to identify the three regimes of propagation (viscosity, toughness, and leak-off).

The range of values of the evolution parameters $P_1$ and $P_2$ for which the fracture propagates in one of the primary regimes (viscosity, toughness, and leak-off) can be identified. The criteria in terms of the numbers $P_1$ and $P_2$ can be translated in terms of the physical parameters (i.e., the injection rate $Q_o$, the fluid viscosity $\mu$, the rock toughness $K_{Ic}$, the leak-off coefficient $C_l$, and the rock elastic modulus E').

The primary regimes of fracture propagation (corresponding to the vertices of the MKC diagram) are characterized by a simple power law dependence of the solution on time. Along the edges of the MKC triangle, outside the regions of dominance of the corners, the evolution of the solution can readily be tabulated.

In some embodiments of the present invention, the tabulated solutions are used for quick design of hydraulic fracturing treatments. In other embodiments, the tabulated solutions are used to interpret real-time measurements during fracturing, such as down-hole pressure.

The derived solutions can be considered as exact within the framework of assumptions, since they can be evaluated to practically any desired degree of accuracy. These solutions are therefore useful benchmarks to test numerical simulators currently under development.

3. Derivation of Solutions Along Edges of the Triangular Parametric Space

Derivation of the solution along the edges of the triangle MKC and at the C-vertex are now described. The identification of the different regimes of fracture propagation are also described.

a. CK-Solution

Along the CK-edge of the MKC triangle, the influence of the viscosity is neglected and the solution depends only on one parameter (either $K_c$, the dimensionless toughness in the leak-off scaling, or the dimensionless leak-off coefficient $C_k$ in the toughness scaling $C_k$). In one embodiment, the solution is constructed starting from the impermeable case (K-vertex) and it is evolved with increasing $C_k$ towards the C-vertex.

Since the fluid is taken to be inviscid along the CK-edge, the pressure distribution along the fracture is uniform and the corresponding opening is directly deduced by integration of the elasticity equation (44)

$$\Pi_{kc} = \Pi_{kc}(C_k),\ \Omega_{kc} = \frac{8}{\pi}\gamma_{kc}\Pi_{kc}\sqrt{1-\rho^2} \tag{53}$$

Combining (53) with the propagation criterion (47) yields $$\Pi_{kc} = \frac{\pi}{8\sqrt{2}}\gamma_{kc}^{-1/2},\ \Omega_{kc} = \left(\frac{\gamma_{kc}}{2}\right)^{1/2}\sqrt{1-\rho^2} \tag{54}$$

The radius $\gamma_{kc}$ is determined as a function of $C_k$. An equation for $\gamma_{kc}$ can be deduced from the global balance of mass $$\frac{d\gamma_{kc}}{dC_k} = \frac{4}{3C_k}\frac{\gamma_k^{5/2}}{\gamma_{kc}^{3/2}}\left[1-\left(\frac{\gamma_{kc}}{\gamma_k}\right)^{5/2}\right] - \frac{8\pi}{3}\frac{\gamma_{kc}^{1/2}}{\gamma_k^{5/2}}I(C_k) \tag{55}$$

where $$\gamma_k \equiv \gamma_{kc}(0) = \left(\frac{3}{\pi\sqrt{2}}\right)^{5/2},\ \text{and}\ I(X) = \int_0^1 \frac{1}{\sqrt{1-\tau_o(\rho, X)}}\rho d\rho \tag{56}$$

with $\tau_o=t_o(r)/t$ denoting the scaled exposure time of point r. The function $\tau_o(\rho,X)$ can be found by inverting $$\rho = \tau_o^{2/5}\frac{\gamma_{kc}(\tau_o^{3/10}X)}{\gamma_{kc}(X)} \tag{57}$$

which is deduced from the definition of ρ by taking into account the power law dependence of $L_k$ and $C_k$ on time.

Since $\tau_o(1,X)=1$, the integral I(X) defined in (56) is singular at ρ=1. This singularity is weak, and its strength is known at X=0 and X=∞: $X=0(\tau_o=\rho^{5/2})$ and at $X=\infty(\tau_o=\rho^4)$. From a computational point of view, the integral can be calculated along the time axis with respect to $\tau_o$ $$I(X) = \frac{1}{\gamma_{kc}(X)}\int_0^1 \frac{1}{\tau_o^{3/5}(1-\tau_o)^{1/2}}\left[\frac{2}{5}\gamma_{kc}(\tau_o^{3/10}X) + \frac{3}{10}\tau_o^{3/10}X\gamma'_{kc}(\tau_o^{3/10}X)\right]d\tau_o \tag{58}$$

In some embodiments of the present invention, the solution can be obtained by solving the non-linear ordinary differential equation (55), using an implicit iterative algorithm.

b. MK-Solution

The MK-solution corresponds to regimes of fracture propagation in impermeable rocks. One difficulty in obtaining this solution lies in handling the changing nature of the tip behavior between the M- and the K-vertex. The tip asymptote is given by the classical square root singularity of linear elastic fracture mechanics (LEFM) whenever $K_m\neq 0$. However, near the M-vertex (small $K_m$), the LEFM behavior is confined to a small boundary layer, which does not influence the propagation of the fracture. In this viscosity-dominated regime, the singularity (50) develops as an intermediate asymptote.

The solution can be searched for in the form of a finite series of known base functions $$\Pi_{km} = \Pi_o^*(\rho, M_k) + \sum_{i=1}^{n_\Pi} A_i(M_k)\Pi_i^*(\rho) + B(M_k)\Pi^{**}(\rho) \tag{59}$$

$$\overline{\Omega}_{km} = \overline{\Omega}_o^*(\rho, M_k) + \sum_{i=1}^{n_\Omega} C_i(M_k)\overline{\Omega}_i^*(\rho) + B(M_k)\overline{\Omega}^{**}(\rho) \tag{60}$$

where the introduction of $\overline{\Omega}_{km}=\Omega_{km}/\gamma_{km}$ excludes $\gamma_{km}$ from the elasticity equation (44).

Since the non-linearity of the problem only arises from the lubrication equation (45), the series expansions (59) and (60) can be used to satisfy the elasticity equation and the boundary conditions at the tip and at the inlet. In the proposed decomposition, the last terms $\{\Pi^{},\overline{\Omega}^{}\}$ are chosen such that the logarithmic pressure singularity near the inlet is satisfied. The corresponding opening is integrated by substituting this pressure function into (44). The first terms in the series $\{\Pi_o^*,\overline{\Omega}_o^*\}$ are constructed to exactly satisfy the propagation equation and to account for the logarithmic pressure asymptote near the tip (which results from substituting the opening square root asymptote into the lubrication equation). It is also required that $\{\Pi_o^*,\overline{\Omega}_o^*\}$ exactly satisfy the elasticity equation (44). The regular part of the solution is represented by series of base functions $\{\Pi_i^*,\overline{\Omega}_i^*\}$ The choice of these functions is not unique; however, it seems consistent to require that $\overline{\Omega}_i^*\sim(1-\rho)^{1/2+i}$ for ρ~1. (The square root opening asymptote appears only in the first term, if one imposes that the function $\Pi_i^*$ does not contribute to the stress intensity factor.) A convenient choice of these base functions are Jacobi polynomials with the appropriate weights.

Any pair $\{\Pi_i^*,\overline{\Omega}_i^*\}$ does not satisfy the elasticity equation (44). Instead, the coefficients $A_i$ and $C_i$ are related by the elasticity equation through the matrix $L_{ij}$ (which is independent of $M_k$ or $K_m$).

$$C_i^{(n_\Omega,n_\Pi)} = \sum_{j=1}^{n_\Pi} L_{ij}A_j^{(n_\Omega,n_\Pi)} \tag{61}$$

The problem is reduced to finding $n_\Pi+1$ unknown coefficients $A_i$ and B, by solving the lubrication equation (45), which simplifies here to $$\rho\overline{\Omega}_{km}^3\frac{\partial\Pi_{km}}{\partial\rho} + M_k\int_\rho^1 \overline{\Omega}_{km}s\,ds + \frac{4}{5}M_k\rho^2\overline{\Omega}_{km} - -\frac{2}{5}M_k^2\left[\int_\rho^1 \frac{\partial\overline{\Omega}_{km}}{\partial M_k}s\,ds + \frac{2}{\gamma_{km}}\frac{d\gamma_{km}}{dM_k}\left(\int_\rho^1 \overline{\Omega}_{km}s\,ds + \rho^2\overline{\Omega}_{km}\right)\right] = 0 \tag{62}$$

where $\gamma_{km}=(2\pi\int_{92}\overline{\Omega}_{km}\rho d\rho)^{-1/3}$

In some embodiments of the present invention, the lubrication equation is solved by an implicit iterative procedure. For example, the solution at the current iteration can be found by a least squares method.

c. CM-Solution

In some embodiments, the solution along the CM-edge of the MKC triangle is found using the series expansion technique described above with reference to the MK-solution. In other embodiments, a numerical solution is used based on the following algorithm.

The displacement discontinuity method is used to solve the elasticity equation (44). This method yields a linear system of equations between aperture and net pressure at nodes along the fracture. The coefficients (which can be evaluated analytically) need to be calculated only once as they do not depend on $C_m$. The lubrication equation (45) is solved by a finite difference scheme (either explicit or implicit). The fracture radius $\gamma_{mc}$ is found from the global mass balance. Here, the numerical difficulty is to calculate the amount of fluid lost due to the leak-off.

The propagation is governed by the asymptotic behavior of the solution at the fracture tip. The tip asymptote can be used to establish a relationship between the opening at the computational node next to the tip and the tip velocity. However, this relationship evolves as $C_m$ increases from 0 to ∞ (i.e., when moving from the M- to the C-vertex); it is obtained through a mapping of the autonomous solution of a semi-infinite hydraulic fracture propagating at constant speed in a permeable rock.

d. Solution Near the C-Vertex

The limit solution at the C-vertex, where both the viscosity and the toughness are neglected, is degenerated as all the fluid injected into the fracture has leaked into the rock. Thus the opening and the net pressure of the fracture is zero, while its radius is finite. In some embodiments of the present invention, the solution near the C-vertex is used for testing the numerical solutions along the CK and CM sides of the parametric triangle. The limitation of those solutions comes from the choice of the scaling. In order to approach the C-vertex, the corresponding parameter ($C_k$ or $C_m$) must grow indefinitely. Practically, these solutions are calculated up to some finite values of the parameters, for which they can be connected with asymptotic solutions near the C-vertex along CM and CK sides. These asymptotic solutions can be constructed as follows.

Consider first the CM-solution $F_{cm}=\{\Omega_{cm}(\rho,M_c),\Pi_{cm}(\rho,M_c),\gamma_{cm}(M_c)\}$ near the C-vertex. It can be asymptotically approximated as $$\gamma_{cm}=\gamma_c o(M_c),\ \Omega_{cm}=M_c^{\alpha}\gamma_c\overline{\Omega}_{cm}(\rho)+o(M_c^{\alpha}),\ \Pi_{cm}=M_c^{\alpha}\overline{\Pi}_{cm}(\rho)+o(M_c^{\alpha}) \tag{63}$$

where $\gamma_c$ denotes the finite fracture radius (in the leak-off scaling) at the C-vertex. The exponent $\alpha=1/4$ is determined by substituting these expansions into the lubrication equation (45), which then reduces to $$\frac{\gamma_c}{\sqrt{1-\rho^4}}=\frac{1}{\rho}\frac{d}{d\rho}\left(\rho\overline{\Omega}_{cm}^3\frac{d\overline{\Pi}_{cm}}{d\rho}\right) \tag{64}$$

The asymptotic solution $\overline{F}_{cm}=\{\overline{\Omega}_{cm}(\rho),\overline{\Pi}_{cm}(\rho)\}$ near the C-vertex is found by solving (64) along with the elasticity equation (44). This can be done using the series expansion technique described above. This problem is similar to the problem at the M-vertex (fracture propagating in an impermeable solid with zero toughness), but with a different tip asymptote. Thus a set of base functions different from the one used for the M-corner are introduced.

The CK-solution $F_{ck}=\{\Omega_{ck}(\rho,K_c),\Pi_{ck}(\rho,K_c),\gamma_{ck}(K_c)\}$ near the C-vertex can also be sought in the form of an asymptotic expansion $$\gamma_{ck}=\gamma_c+o(K_c),\ \Omega_{ck}=K_c^{\beta}\gamma_c\overline{\Omega}_{ck}(\rho)+o(K_c^{\beta}),\quad \Pi_{ck}=K_c^{\beta}\Pi_{ck}(\rho)+o(K_c^{\beta}) \tag{65}$$

where $\beta=1$ is determined from the propagation condition (11). This solution is trivial, however, since the pressure is uniform; hence $$\Pi_{ck}=\frac{\pi}{8}(2\gamma_c)^{-1/2},\ \overline{\Omega}_{ck}=(2\gamma_c)^{-1/2}\sqrt{1-\rho^2} \tag{66}$$

e. Regimes of Fracture Propagation

The regimes of fracture propagation can readily be identified once the solutions at the vertices and along the edges of the MKC triangle have been tabulated using the algorithms and methods of solutions described above. Recall that for the parametric space under consideration, there are three primary regimes of propagation (viscosity, toughness, and leak-off) associated with the vertices of the MKC triangle and that in a certain neighborhood of a corner, the corresponding process is dominant, see Table 5. For example, fracture propagation is in the viscosity-dominated regime if $K_m<K_{mm}$ and $C_m<C_{mm}$; in this region, the solution can be approximated for all practical purposes by the zero-toughness, zero-leak-off solution at the M-corner ($K_m=0$, $C_m=0^-$).

TABLE 5

Range of the parameters $P_1$ and $P_2$ for which a primary process is dominant.

| Dominant Process | Range on $P_1$ | Range on $P_2$ |
|---|---|---|
| Viscosity | $K_m < K_{mm}$ ($M_k > M_{km}$) | $C_m < C_{mm}$ ($M_c > M_{cm}$) |
| Toughness | $C_k < C_{kk}$ ($K_c > K_{ck}$) | $M_k < M_{kk}$ ($K_m > K_{mk}$) |
| Leak-off | $M_c < M_{cc}$ ($C_m > C_{mc}$) | $K_c < K_{cc}$ ($C_k < C_{kc}$) |

Identification of the threshold values of the evolution parameters (for example, $K_{mm}$ and $C_{mm}$ for the viscosity-dominated regime) can be accomplished by comparing the fracture radius with its reference value at a corner. The corner process is considered as dominant, if the fracture radius is within 1% of its value at the corner. For example, $K_{mm}$ and $C_{mm}$ are deduced from the following conditions $$|\gamma_{mk}(K_{mm})-\gamma_m|/\gamma_m=1\%,\ |\gamma_{mk}(C_{mm})-\gamma_m|/\gamma_m=1\% \tag{67}$$

B. Plane Strain (KGD) Fractures

1. Governing Equations and Boundary Conditions

Elasticity $$w=\frac{l}{E'}\int_0^1 G(x/l,s)\Pi(sl,t)ds \tag{68}$$

Lubrication $$\frac{\partial w}{\partial t}+g=\frac{1}{\mu'}\frac{\partial}{\partial x}\left(w^3\frac{\partial p}{\partial x}\right) \tag{69}$$

obtained by eliminating the radial flow rate q(x,t) between the fluid mass balance $$\frac{\partial w}{\partial t}+\frac{\partial q}{\partial x}+g=0 \tag{70}$$

and Poiseuille law $$q=-\frac{w^3}{\mu'}\frac{\partial p}{\partial x} \tag{71}$$

Leak-off $$g=\frac{C'}{\sqrt{t-t_o(x)}} \tag{72}$$

where $t_o(x)$ is the exposure time of point x

Global Volume Balance $$Q_o t = 2\int_0^{l(t)} w\,dx + 2\int_0^{t}\int_0^{l(\tau)} g(x,\tau)\,dx\,d\tau \tag{73}$$

Propagation Criterion $$w \simeq \frac{K'}{E'}\sqrt{l-x},\ 1-\frac{x}{l} \ll 1 \tag{74}$$

Tip Conditions $$w=0,$$

$$w^3\frac{\partial p}{\partial x} = 0, \quad x = l \tag{75}$$

2. Scaling

Similarly to the radial fracture, we define the dimensionless crack opening $\Omega$, net pressure $\Pi$, and fracture length $\gamma$ as $$w(x,t)=\epsilon(t)L(t)\Omega(\xi;P_1P_2) \tag{76}$$

$$p(x,t)=\epsilon(t)E'\Pi(\xi;P_1P_2) \tag{77}$$

$$l(t)=\gamma(\xi;P_1P_2)L(t) \tag{78}$$

These definitions introduce a scaled coordinate $\xi=x/l(t)$ ($0\leqq\xi\leqq1$), a small number $\epsilon(t)$, a length scale $L(t)$ of the same order of magnitude as the fracture length $l(t)$, and two dimensionless parameters $P_1(t)$, $P_2(t)$ which depend monotonically on t. The form of the scaling (76)–(80) can be motivated from elementary elasticity considerations, by noting that the average aperture scaled by the fracture radius is of the same order as the average net pressure scaled by the elastic modulus. Explicit forms of the parameters $\epsilon(t)$, $L(t)$, $P_1(t)$, and $P_2(t)$ are given below for the viscosity, toughness, and leak-off scalings.

The main equations are transformed as follows, under the scaling (76)–(80).

Elasticity Equation $$\Omega=\gamma\int_0^1 G(\xi,s)\Pi(s;P_1,P_2)ds \tag{79}$$

Lubrication Equation.

The left-hand side $\partial w/\partial t$ of the lubrication equation (69) can now be written as $$\frac{\partial w}{\partial t} + g = (\dot{\varepsilon}L+\varepsilon\dot{L})\Omega - \varepsilon\dot{L}\xi\frac{\partial\Omega}{\partial\xi} + \varepsilon L\dot{P}_1\left(\frac{\partial\Omega}{\partial P_1} - \frac{\xi}{\gamma}\frac{\partial\gamma}{\partial P_1}\frac{\partial\Omega}{\partial\xi}\right) + \varepsilon L\dot{P}_2\left(\frac{\partial\Omega}{\partial P_2} - \frac{\xi}{\gamma}\frac{\partial\gamma}{\partial P_2}\frac{\partial\Omega}{\partial\xi}\right) + C't^{-\frac{1}{2}}\Gamma(\xi;P_1,P_2) \tag{80}$$

while the right hand side is transformed into $$\frac{1}{\mu'}\frac{\partial p}{\partial x}\left(w^3\frac{\partial p}{\partial x}\right) = \frac{\varepsilon^4E'L}{\mu'\gamma^2}\frac{\partial}{\partial\xi}\left(\Omega^3\frac{\partial\Pi}{\partial\xi}\right) \tag{81}$$

The leak-off function $\Gamma(\xi;P_1,P_2)$, which is defined as $$\Gamma(\xi;P_1,P_2) = \frac{1}{\sqrt{1-t_o/t}},\ t > t_o \tag{82}$$

can be computed as part of the solution, once the parameters $P_1,P_2$ have been identified. After multiplying both sides by $t/\epsilon R$, we obtain a new form of the lubrication equation $$\left(\frac{\dot{\varepsilon}t}{\varepsilon} + \frac{\dot{L}t}{L}\right)\Omega - \frac{\dot{L}t}{L}\xi\frac{\partial\Omega}{\partial\xi} + \dot{P}_1t\left(\frac{\partial\Omega}{\partial P_1} - \frac{\xi}{\gamma}\frac{\partial\gamma}{\partial P_1}\frac{\partial\Omega}{\partial\xi}\right) + \dot{P}_2t\left(\frac{\partial\Omega}{\partial P_2} - \frac{\xi}{\gamma}\frac{\partial\gamma}{\partial P_2}\frac{\partial\Omega}{\partial\xi}\right) + \frac{C't^{\frac{1}{2}}}{\varepsilon L}\Gamma = \frac{\varepsilon^3E't}{\mu'}\frac{1}{\gamma^2}\frac{\partial}{\partial\xi}\left(\Omega^3\frac{\partial\Pi}{\partial\xi}\right) \tag{83}$$

Global Mass Balance $$2\gamma\int_0^l \Omega\,d\rho + 2\frac{C't^{\frac{1}{2}}}{\varepsilon L}\int_0^l u^{\alpha-1/2}\gamma(\tau_o^{\beta_1}P_1,\tau_o^{\beta_2}P_2)I(\tau_o^{\beta_1}P_1,\tau_o^{\beta_2}P_2)du = \frac{Q_o t}{\varepsilon L^2} \tag{84}$$

where I is given by $I(X_1,X_2)=\int_0^1\Gamma(\xi;X_1,X_2)d\xi$

Propagation Criterion $$\Omega = \frac{K'}{\varepsilon E'L^{\frac{1}{2}}}\gamma^{\frac{1}{2}}(1-\xi)^{\frac{1}{2}}\ 1-\xi \ll 1 \tag{85}$$

These equations show that there are 4 dimensionless groups: $G_v$, $G_m$, $G_k$, $G_c$, (only $G_v$ differs from the radial case, in view of the different dimension of $Q_o$)

$$G_v = \frac{Q_o t}{\varepsilon L^2},\ G_m = \frac{\mu'}{\varepsilon^3E't},\ G_k = \frac{K'}{\varepsilon E'L^{1/2}},\ G_c = \frac{C't^{1/2}}{\varepsilon L} \tag{86}$$

a. Viscosity Scaling.

The small parameter $\epsilon_m$ and the lengthscale $L_m$ are determined by setting $G_v=1$ and $G_m=1$. Hence, $$\varepsilon_m = \left(\frac{\mu'}{E't}\right)^{1/3},\ L_m = \left(\frac{E'Q_o^3t^4}{\mu'}\right)^{1/6} \tag{87}$$

The two parameters $P_1=G_k$ and $P_2=G_c$ are identified as $K_m$ and $C_m$, a dimensionless toughness and a dimensionless leak-off coefficient, respectively $$K_m = K'\left(\frac{1}{E'^3\mu' Q_o}\right)^{1/4},\ C_m = C'\left(\frac{E' t}{\mu' Q_o^3}\right)^{1/6} \tag{88}$$

b. Toughness Scaling.

Now, $\epsilon_k$ and $L_k$ are determined from $G_v=1$ and $G_k=1$. Hence, $$\varepsilon_k = \left(\frac{K'^4}{E'^4 Q_o t}\right)^{1/3},\ L_k = \left(\frac{E' Q_o t}{K'}\right)^{2/3} \tag{89}$$

The two parameters $P_1=G_m$ and $P_2=G_c$ correspond to $M_k$ and $C_k$, a dimensionless viscosity and a dimensionless leak-off coefficient, respectively $$M_k = \mu'\left(\frac{E'^3 Q_o}{K'^4}\right),\ C_k = C'\left(\frac{E'^4 t}{K'^4 Q_o^2}\right)^{1/6} \tag{90}$$

c. Leak-Off Scaling.

Finally, the leak-off scaling corresponds to $G_v=1$ and $G_c=1$. Hence, $$\varepsilon_c = \frac{C'^2}{Q_o} \quad L_c = \left(\frac{Q_o^2 t}{C'^2}\right)^{1/2} \tag{91}$$

and the two parameters $P_1=G_k$ and $P_2=G_m$ are now identified as $K_c$ and $M_c$, a dimensionless viscosity and a dimensionless toughness, respectively $$K_c = K'\left(\frac{Q_o^2}{E'^4 C'^6 t}\right)^{1/4},\ M_c = \mu'\left(\frac{Q_o^3}{E' C'^6 t}\right) \tag{92}$$

We note that both $C_k$, $C_m$ are positive power of time t while $K_c$, $M_c$ are negative power of t. Hence, the leak-off scaling is appropriate for large time, and either the viscosity scaling or the toughness scaling is appropriate for small time. As discussed below, the solution starts from a point on the MK-side of a ternary parameter space ($C_k=0$, $C_m=0$) and tends asymptotically towards the C-point ($M_c=0$, $K_c=0$), following a straight trajectory which is controlled by a certain number η, a function of all the problem parameters except C' (i.e., $Q_o$, E', μ', K')

3. Time Scales

It is of interest to express the small parameters ϵ's, the length scales L's, and the dimensionless parameters M's, K's, and C's in terms of time scales. Two time scales $t_m$, $t_k$ are naturally defined as $$t_m = \frac{\mu'}{E'},\ t_k = \frac{K'^4}{E'^4 Q_o} \tag{93}$$

Note that unlike the radial fracture, it is not possible to define a characteristic time $t_c$, since $Q_o$ has the dimension squared of C'. Hence, $$\varepsilon_m = \left(\frac{t_m}{t}\right)^{1/3},\ \varepsilon_k = \left(\frac{t_k}{t}\right)^{1/3} \tag{94}$$

$$L_m = \left(\frac{t}{t_m}\right)^{2/3}\bar{L}_m,\ L_k = \left(\frac{t}{t_k}\right)^{2/3}\bar{L}_k \tag{95}$$

where the $\bar{L}$'s are intrinsic length scales defined as $$\bar{L}_m = \left(\frac{\mu'^3 Q_o^3}{E'^3}\right)^{1/6},\ \bar{L}_k = \left(\frac{K'}{E'}\right)^2 \tag{96}$$

Next, consider the dimensionless parameters M's, K's, and C's which can be rewritten in terms of the characteristic times $t_{cm}$, and $t_{ck}$ $$C_m = \left(\frac{t}{t_{cm}}\right)^{1/6},\quad C_k = \left(\frac{t}{t_{ck}}\right) \tag{97}$$

$$M_c = \left(\frac{t_{cm}}{t}\right),\quad K_c = \left(\frac{t_{ck}}{t}\right)^{1/4} \tag{98}$$

$$\text{where } t_{cm} = \varepsilon_c^{-3} t_m = \left(\frac{\mu' Q_o^3}{E' C'^6}\right),\quad t_{ck} = \varepsilon_c^{-3} t_k = \left(\frac{K'^4 Q_o^2}{E'^4 C'^6}\right) \tag{99}$$

It is thus convenient to introduce a parameter η related to the ratios of characteristic times, which is defined as $$\eta = \frac{K'^4}{E'^3 \mu' Q_o} \tag{100}$$

Indeed, it is easy to show that the various characteristic time ratios can be expressed in terms of η

$$\frac{t_{ck}}{t_{cm}} = \eta \tag{101}$$

Note also that η can be expressed as $$\eta = \frac{\bar{L}_k^2}{\bar{L}_m^2} \tag{102}$$

Furthermore, if we introduce the dimensionless time τ

$$\tau = \frac{t}{t_{cm}} \tag{103}$$

(acknowledging at the same time that the choice of $t_{cm}$ to scale the time is arbitrary, as $t_{ck}$ could have been used as well), the parameters M's, K's, and C's can be expressed in terms of τ and η as follows $$K_m=\eta^{1/4},\ C_m=\tau^{1/6},\ C_k\eta^{-1/6}\tau^{1/6} \tag{104}$$

$$M_k=\eta^{-1},\ M_c=\tau^{-1},\ K_c=\eta^{1/4}\tau^{-1/4} \tag{105}$$

The dependence of the scaled solution $F=\{\Omega,\Pi,\gamma\}$ is thus of the form $F(\xi,\tau;\eta)$, irrespective of the adopted scaling (but $\gamma=\gamma(\tau;\eta)$). In other words, the scaled solution is a function of dimensionless spatial and time coordinate, $\xi$ and $\tau$, which depends on only one parameter, $\eta$, which is constant for a particular problem. Thus the laws of similitude between field and laboratory experiments simply require that $\eta$ is preserved and that the range of dimensionless time $\tau$ is the same—even for the general case of viscosity, toughness, and leak-off.

Figure 12:
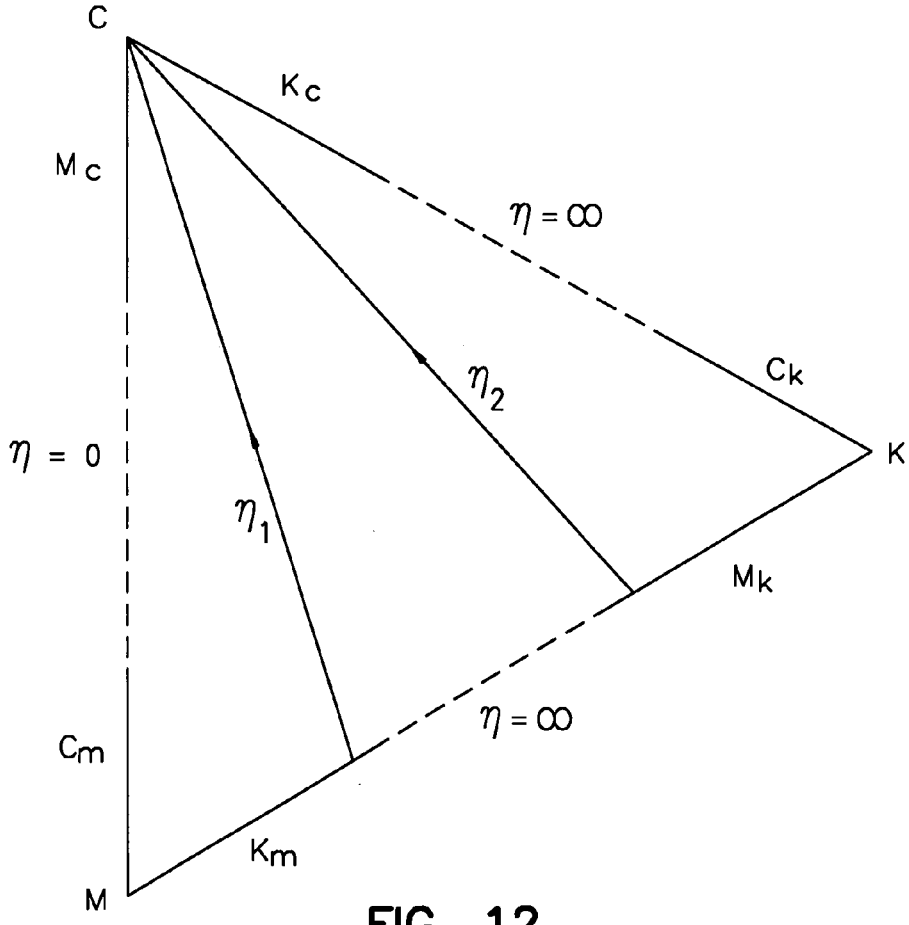
FIG. 12 shows another triangular parametric space with two trajectories.

It is again convenient to introduce the ternary diagram MKC shown in FIG. 12. With time $\tau$, the system evolves along a $\eta$-trajectory (along which $\eta$ is a constant), starting from a point on the MK-side and ending at the C-vertex. If $\eta=0$ (the rock has zero toughness), the evolution from M to C is done directly along the base BC of the ternary diagram MKC. For $\eta=\infty$, the fluid is inviscid and the system then evolves from K to C.

The KGD fracture differs from the radial fracture by the existence of only characteristic time rather than two for the penny-shaped fracture. The characteristic number $\eta$ for the KGD fracture is independent of the leak-off coefficient C', which only enters the scaling of time.

4. Relationship Between Scalings

Any scaling can be translated into any of the other two. It can readily be established that $$K_m=M_k^{-1/4},\ C_m=M_c^{-1/6},\ C_k=K_c^{-2/3} \tag{106}$$

and $$\frac{\varepsilon_m}{\varepsilon_k}=M_k^{1/3}=K_m^{-4/3} \tag{107}$$

$$\frac{\varepsilon_k}{\varepsilon_c}=K_c^{4/3}=C_k^{-2} \tag{108}$$

$$\frac{\varepsilon_c}{\varepsilon_m}=C_m^{2}=M_c^{-1/3} \tag{109}$$

$$\frac{L_m}{L_k}=M_k^{-1/6}=K_m^{2/3} \tag{110}$$

$$\frac{L_k}{L_c}=K_c^{-2/3}=C_k \tag{111}$$

$$\frac{L_c}{L_m}=C_m^{-1}=M_c^{1/6} \tag{112}$$

III. Applications

Applications of hydraulic fracturing include the recovery of oil and gas from underground reservoirs, underground disposal of liquid toxic waste, determination of in-situ stresses in rock, and creation of geothermal energy reservoirs. The design of hydraulic fracturing treatments benefits from information that characterize the fracturing fluid, the reservoir rock, and the in-situ state of stress. Some of these parameters are easily determined (such as the fluid viscosity), but for others, it is more difficult (such as physical parameters characterizing the reservoir rock and in-situ state of stress).

By utilizing the various embodiments of the present invention, the "difficult" parameters can be assessed from measurements (such as downhole pressure) collected during a hydraulic fracturing treatment. The various embodiments of the present invention recognize that scaled mathematical solutions of hydraulic fractures with simple geometry depend on only two numbers that lump time and all the physical parameters describing the problem. There are many different ways to characterize the dependence of the solution on two numbers, as described in the different sections above, and all of these are within the scope of the present invention.

Various parametric spaces have been described, and trajectories within those spaces have also been described. Each trajectory shows a path within the corresponding parametric space that describes the evolution of a particular treatment over time for a given set of physical parameter values. That is to say, each trajectory lumps all of the physical parameters, except time. Since there exists a unique solution at each point in a given parametric space, which needs to be calculated only once and which can be tabulated, the evolution of the fracture can be computed very quickly using these pre-tabulated solutions. In some embodiments, pre-tabulated points are very close together in the parametric space, and the closest pre-tabulated point is chosen as a solution. In other embodiments, solutions are interpolated between pre-tabulated points.

The various parametric spaces described above are useful to perform parameter identification, also referred to as "data inversion." Data inversion involves solving the so-called "forward model" many times, where the forward model is the tool to predict the evolution of the fracture, given all the problems parameters. Data inversion also involves comparing predictions from the forward model with measurements, to determine the set of parameters that provide the best match between predicted and measured responses.

Historically, running forward models has been computationally demanding, especially given the complexity of the hydraulic fracturing process. Utilizing the various embodiments of the present invention, however, the forward model includes pre-tabulated scaled solutions in terms of two dimensionless parameters, which only need to be "unsealed" through trivial arithmetic operations. These developments, and others, make possible real-time, or near real-time, data inversion while performing a hydraulic fracturing treatment.

Although the present invention has been described in conjunction with certain embodiments, it is to be understood that modifications and variations may be resorted to without departing from the spirit and scope of the invention as those skilled in the art readily understand. Such modifications and variations are considered to be within the scope of the invention and the appended claims. For example, the scope of the invention encompasses the so-called power law fluids (a generalized viscous fluid characterized by two parameters and which degenerates into a Newtonian fluid when the power law index is equal to 1). Also for example, the scope of the invention encompasses the evolution of the hydraulic fracture following "shut-in" (when the injection of fluid is stopped). Hence, various embodiments of the invention contemplate interpreting data gathered after shut-in.

What is claimed is:

1. A method comprising:

receiving hydraulic fracturing treatment data;

performing inversion of fracture parameters obtained from the hydraulic fracturing treatment data in times that include real time;

evaluating a forward model comprising pre-tabulated solutions in terms of at least two dimensionless evolution parameters to predict the evolution of a fracture, wherein the forward model comprises pre-tabulated scaled solutions in terms of at least one dimensionless parameter;

and;

unscaling the pre-tabulated solutions to produce a value for at least one physical parameter.

2. The method of claim 1 wherein one of the dimensionless parameters represents a dimensionless leak-off coefficient.

3. The method of claim 1 wherein the at least two dimensionless evolution parameters comprise monotonic functions of time.

4. The method of claim 1 wherein the hydraulic fracturing treatment data comprises a pressure of a viscous fluid.

5. The method of claim 1 wherein the hydraulic fracturing treatment data comprises a fracture dimension.

6. A method of designing a hydraulic fracturing treatment comprising:

receiving hydraulic fracturing treatment data;

performing inversion of fracture parameters obtained from the hydraulic fracturing treatment data in times that include real time;

storing pre-tabulated solutions that represent problem solution points in a parametric space, wherein the parametric space corresponds to a scaling of the problem parameters comprising one or more of a dimensionless crack opening and a dimensionless net pressure; and determining a volumetric rate based on a desired trajectory in the parametric space.

7. The method of claim 6 wherein the scaling comprises a dimensionless fracture radius.

* * * * *